US006123417A

United States Patent [19]

Bard et al.

[11] Patent Number: 6,123,417

[45] Date of Patent: Sep. 26, 2000

[54] OPTIMIZATION OF TRANSPORT PARAMETERS FOR TRAVELING WAVE TONER TRANSPORT DEVICES

[75] Inventors: Erik Christopher Bard, Provo, Utah; Gary Allen Denton, Lexington; David Daniel Dreyfuss, Nicholasville, both of Ky.

[73] Assignee: Lexmark International, Inc., Lexington, Ky.

[21] Appl. No.: 08/993,846

[22] Filed: Dec. 18, 1997

[51] Int. Cl.[7] ..... B41J 2/06

[52] U.S. Cl. ..... 347/55

[58] Field of Search ..... 347/55, 154, 103, 347/123, 111, 159, 127, 128, 17, 141, 120; 399/289

[56] References Cited

U.S. PATENT DOCUMENTS 4,733,256 3/1988 Salmon .
4,777,500 10/1988 Salmon .
5,030,976 7/1991 Salmon .
5,153,617 10/1992 Salmon .
5,257,046 10/1993 Schmidlin .
5,281,982 1/1994 Mosehauer et al. .
5,287,127 2/1994 Salmon .
5,400,062 3/1995 Salmon .
5,416,568 5/1995 Yoshiki et al. .

*Primary Examiner*—John Barlow
*Assistant Examiner*—Raquel Yvette Gordon
*Attorney, Agent, or Firm*—Steven D. Gilliam

[57] ABSTRACT

Various methods and apparatus are disclosed for facilitating the loading, transportation, and modulation of toner particles on a print head, as well as the transfer of toner particles onto a print medium. These methods and apparatus relate to the optimization of various elements on the print head to improve the speed and control of toner particles on the print head, as well as to the alteration of the electric field in the vicinity of the end of the print head.

86 Claims, 24 Drawing Sheets

OPTIMIZATION OF TRANSPORT PARAMETERS FOR TRAVELING WAVE TONER TRANSPORT DEVICES

CROSS-REFERENCE TO RELATED APPLICATIONS

This application is related to U.S. patent application Ser. No. 08/993,736, filed on Dec. 18, 1997, and entitled "Methods and Apparatus for Focusing Toner Particles," to U.S. patent application Ser. No. 08/993,896, filed on Dec. 18, 1997, and entitled "Toner Transport Device Having Improvements For to Transferring Toner Particles," to U.S. patent application Ser. No. 08/993,651, filed on Dec. 18, 1997, and entitled traveling wave and "Vertical Toner Transfer," and to U.S. patent application Ser. No. 08/993,650, filed on Dec. 18, 1997, and entitled "Scanning Print Head."

BACKGROUND OF THE INVENTION

1. Field of the Invention

The present invention relates generally to xerographic printing and, more particularly, to the optimization of toner transport parameters for a xerographic printer utilizing a traveling wave toner transport device.

2. Background of the Related Art

In modern society, among the most common and useful printing devices are printers that are used in conjunction with computers to print a variety of subject matter, such as text, graphics, and even photographic reproductions. These "computer" printers may be categorized in any number of ways. However, for the purposes of this discussion, these types of printers will be categorized, initially, as monochromatic and color printers. Monochromatic printers use a single color ink or toner, which is a form of powdered imaging material that can be charged and moved with electric fields. Most monochromatic printers are capable of producing gray and black images on a print medium, such as paper, transparencies, etc. Color printers, on the other hand, typically contain several colors of ink or toner, such as cyan, magenta, and yellow, which produce the color images, as well as black, which produces the black and gray images. As described in greater detail below, just as certain monochromatic printers have the ability to produce certain shades of gray, these color images may be produced, to some extent, in different color hues and saturations.

As far as computer printers are concerned, color printers are a relatively recent innovation. Therefore, historically, computer printers have been categorized primarily based upon the type of technology used to deliver the ink onto the paper. Such technological categories of printers have included, for instance, daisy wheel printers, ink jet printers, and laser printers. Arguably the most popular printers in today's market, for both monochromatic and color printers, are ink jet printers and laser printers. Unfortunately, each of these types of printers exhibit certain disadvantages, particularly when used as color printers.

Ink jet printers print directly onto paper. In other words, the ink is not deposited on an intermediate substrate which is then transferred from the intermediate substrate to the paper. Rather, ink jet printers use thermally generated bubbles or piezoelectric drivers to expel or "jet" ink drops onto the print-receiving medium. Advantageously, such printers are relatively inexpensive and operate satisfactorily for a variety of purposes. However, ink jet technology demonstrates very limited gray scale level writing ability at the present time. In other words, ink jet printers can only produce a few shades of gray. To provide these limited gray scale levels, ink jet printers may use diluted and full strength inks, smaller ink drops, or modulated drop sizes. In view of these limitations, ink jet printers are unlikely ever to achieve more than a few gray levels.

Toner jet printers also print directly onto paper. To provide this type of direct printing, toner jet printers typically pass toner through an array of holes that is placed in the print head very near the paper. A ring electrode is placed around each hole to control the toner that passes through each hole. This control is possible because the toner is charged prior to delivering it to the array. Accordingly, activation of an electrode essentially pulls the toner through the activated hole, and an electrode may be placed behind the print medium to pull the toner onto the paper.

The saturation of the toner on the paper may be controlled, to some extent, by the time that the particular electrode is activated. In other words, in a monochromatic printer, the electrode may be activated for a relatively short period to produce a gray image and for a relatively long period to produce a black image. Similarly, in a color printer, the electrode is activated for a relatively short period of time to produce a light colored image and for a relatively long period of time to produce a darker colored image.

Disadvantageously, the holes in the array tend to get plugged with toner, so the arrays need to be cleaned periodically. This maintenance may require the array to be removed from the printer for cleaning or replacement, or the printer may be provided with a self-cleaning mechanism that periodically produces a charge in an attempt to attract the charged toner particles away from the array. In an effort to address these concerns, the holes in the array may be made larger to help alleviate the plugging problem. However, this solution is detrimental because increasing the size of the holes increases pixel size, thereby causing the resolution of the printer to suffer.

Laser printers present another set of advantages and disadvantages. On one hand, laser printers are very reliable, require little maintenance, and are capable of printing at relatively high speeds as compared with ink jet printers. On the other hand, laser printers are more complicated and more expensive than comparable ink jet printers. Furthermore, laser printers are essentially analog devices, and it is difficult to control the analog process tightly enough to get satisfactory color control. Rather, various shades of gray or various color densities are produced by the use of "super pixels," i.e., tight groupings of regular pixels having various different colors and/or densities to produce a given effect when viewed at a distance by the human eye.

In an effort to improve upon existing printers, electrostatic printers using traveling wave toner transport devices, sometimes called digital packet printing devices, are under development. Such devices use microscopic patterns of electrodes that are formed using semiconductor fabrication techniques to control small numbers of toner particles. Because of the precise control of the toner that these devices theoretically make possible, it is thought that these devices could produce print images having a higher resolution and much better gray scale control than existing printers. Furthermore, it is thought that these devices could provide high operating speed at a potentially lower cost. However, known traveling wave toner devices have not attained these theoretical advantages.

As discussed in detail below, the present inventors have discovered a variety of problems with currently known traveling wave toner transport devices, as well as a variety of ways to address such problems and improve traveling wave toner transport technology.

SUMMARY OF THE INVENTION

In accordance with one aspect of the present invention, there is provided a toner transport device. The toner transport device generally includes a toner transport surface, a plurality of electrodes positioned and energizable to generate a traveling wave for transporting toner particles, and a plurality of dividers positioned to define a plurality of toner transport channels. The electrodes are energizable in groups which define the wavelength of the traveling wave. One manner of optimizing the toner transport device involves setting the wavelength to between 2.0 to less than 12.0 times the average diameter of the toner particles, such as in the range of about 2.5 to about 8.8 times the average diameter of the toner particles. Another manner of optimizing the toner transport device involves setting the distance between the electrodes to less than twice the average diameter of the toner particles, such as not greater than the average diameter of the toner particles. Yet another manner of optimizing the toner transport device involves creating a smooth or non-conformal toner transport surface, such as by using a dielectric such as benzocyclobutene.

BRIEF DESCRIPTION OF THE DRAWINGS

The foregoing and other advantages of the invention will become apparent upon reading the following detailed description and upon reference to the drawings in which.

DESCRIPTION OF THE SPECIFIC EMBODIMENTS

1. Introduction

Figure 1:
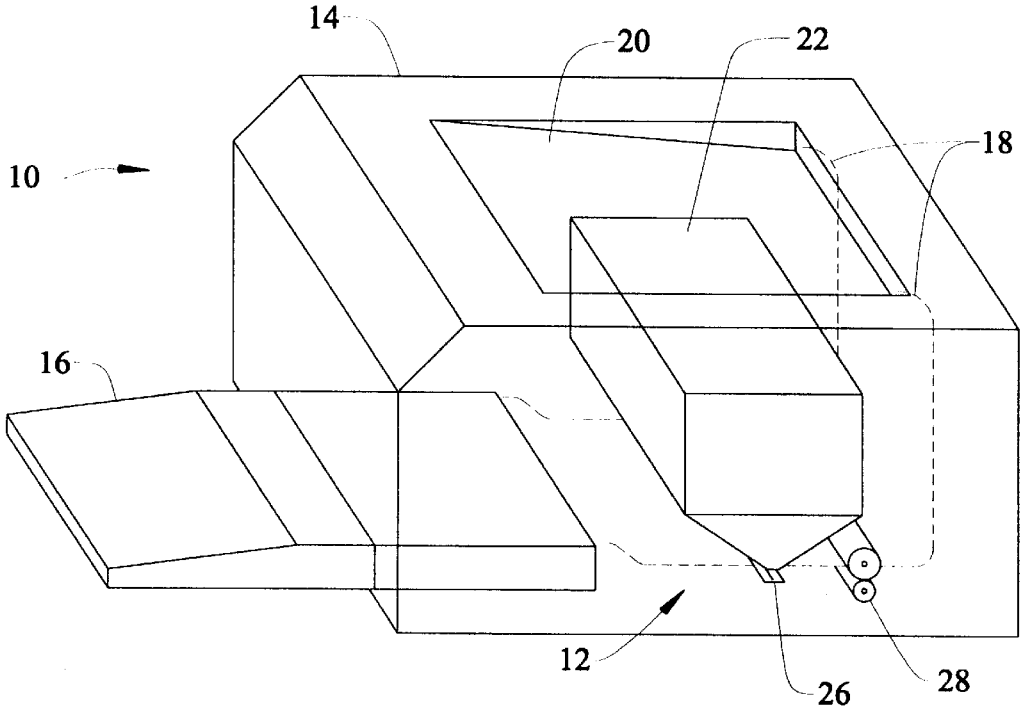
FIG. 1 illustrates a perspective view of a printer in accordance with the present invention.

Turning now to the drawings, and referring initially to FIG. 1, a printer is illustrated and generally designated by a reference numeral 10. The printer 10 includes a print engine 12 that is housed within a case 14. A print medium, such as paper, is stored in an input tray 16. Upon receiving an appropriate print command from an associated source, such as a computer (not shown), paper is fed from the input tray 16 into the print engine by a sheet feeding device. The paper, generally following the path illustrated by the dotted lines 18, passes through the print engine 12 and into a receiving tray 20 that is located in the upper portion of the case 14.

The print engine 12 includes toner reservoirs 22, a toner imaging device 26, and a fuser assembly 28. Although the print engine 12 will be discussed in great detail below, toner from the reservoirs 22 is generally charged and loaded onto the toner imaging device 26. The toner imaging device 26 applies the appropriate image to the paper. This image is then fixed onto the paper by the fuser 28 prior to the paper being deposited in the receiving tray 20.

It should be appreciated that FIG. 1 illustrates a schematic depiction of one type of printer 10. Indeed, due to the general nature of the illustrated printer 10 many elements that the printer 10 may include have not been shown, such as detailed paper transport mechanisms, human interface controls and displays, a system controller board, input/output connections, and power supplies. The printer 10 is illustrated in FIG. 1 as a desk top printer that prints on individual sheets of paper, normally at a speed of 10 to 30 pages per minute. However, it should be understood that the print engine 12 may be used in various types of printers. Furthermore, although the print engine 12 is described below as being configured to print color images, the various aspects of the print engine 12 are also applicable to monochromatic print engines.

Figure 2:
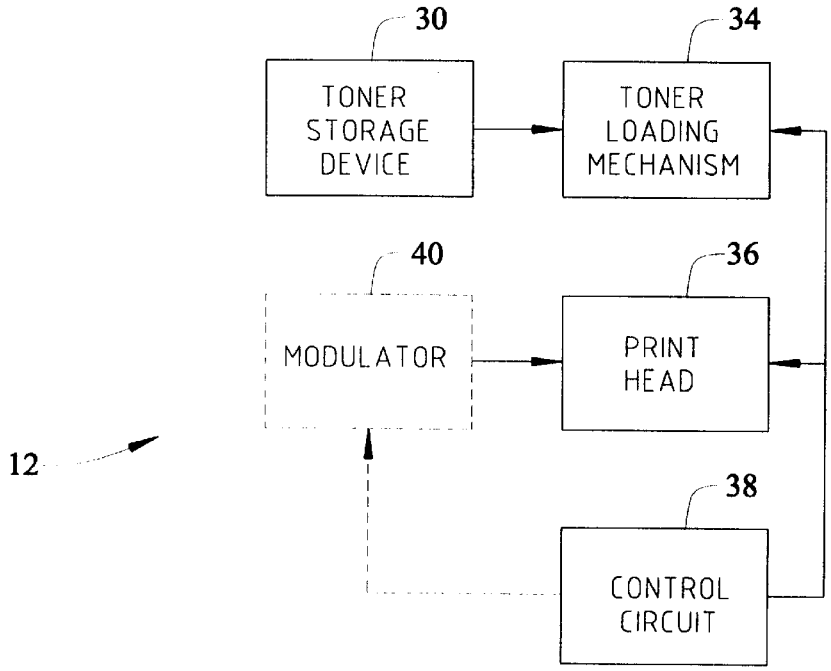
FIG. 2 illustrates a block diagram of a print engine in accordance with the present invention.

A generalized block diagram of the print engine 12 is illustrated in FIG. 2. The toner storage device 30 may include the toner reservoirs 22, mentioned above, or any other suitable toner storage device. These toner particles are delivered to a toner loading mechanism 34 which charges the toner particles and delivers the charged toner particles to the toner imaging device 26 that includes a print head 36. As will become apparent below, a control circuit 38 may be coupled to the toner loading mechanism 34 and/or the print head 36 to control (1) the delivery of the toner particles onto the print head 36, (2) the movement of the toner particles on the print head 36, (3) the manner in which the toner particles are ejected onto the paper from the print head 36, and (4) the movement of the print head 36, if, as discussed subsequently, the print head 36 is coupled to a scanner. The control circuit 38 also may modulate the toner particles on the print head 36. However, as will also become apparent from the following discussion, a separate modulator 40 may be used to modulate the toner particles on the print head 36. In this case, the control circuit 38 may also be coupled to the modulator 40 to control the manner in which the modulator 40 operates on the toner particles on the print head 36.

2. Toner Transportation on a Traveling Wave Device

Figure 3:
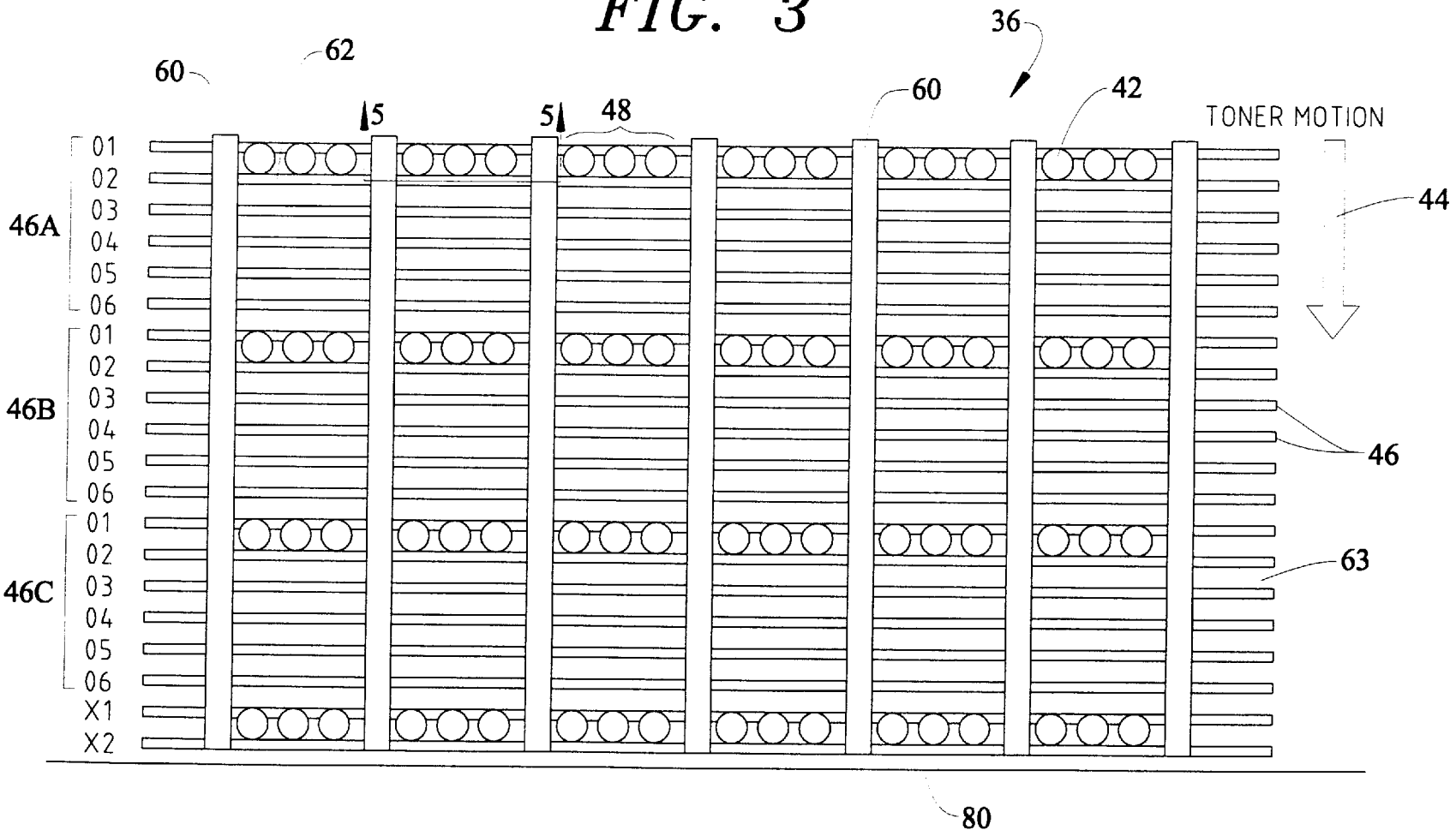
FIG. 3 illustrates a portion of a print head having a traveling wave transport surface.

Prior to discussing specific embodiments of the print engine 12 as a whole and the manner in which each of these embodiments functions, it is important to understand the manner in which the print head 36 transports toner. A portion of one embodiment of the print head 36 is illustrated in FIG. 3. The print head 36 includes a traveling wave drive assembly that causes the toner particles 42 to move generally in the direction of the arrow 44. In this embodiment, the traveling wave drive assembly includes a plurality of electrodes 46 that extend generally perpendicular to the direction of toner motion as illustrated by the arrow 44. Specifically, the electrodes 46 are arranged in groups of six electrodes 46*a*, 46*b*, and 46*c* to produce a 6-phase traveling wave that causes the packets of toner particles 48 to move generally in the direction of the arrow 44. Each electrode 46 in each group of electrodes 46*a*, 46*b*, and 46*c* is connected in order from phase one through phase six, which is illustrated in FIG. 3 by the designations Ø1, Ø2, Ø3, Ø4, Ø5, and Ø6, respectively. As described in detail below, each of the electrodes having the same phase, e.g., each of the electrodes Ø1 in the groups 46*a*, 46*b*, and 46*c*, may be coupled to a common bus that provides the appropriate phase signal to the appropriate electrode 46 in each of the groups of electrodes 46*a*, 46*b*, and 46*c*.

Figure 4:
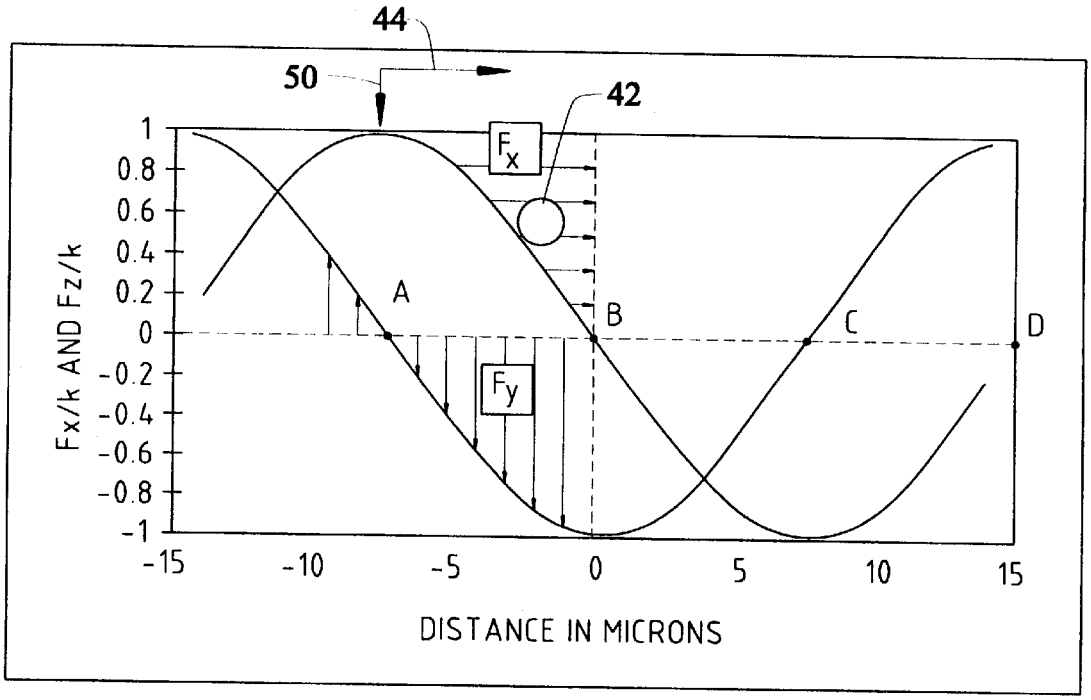
FIG. 4 illustrates a graphical depiction of forces on a particle being transported by a traveling wave.

With this general physical embodiment in mind, the basic concept of such a traveling wave device may be understood by referring additionally to FIG. 4 for a moment. In FIG. 4, a charged toner particle 42 is shown diagrammatically as traveling on an electrostatic wave. As can be seen, the toner particle travels in the X direction, which is the same direction designated by the arrow 44. Indeed, the particle 42 is moved in the X direction by electrical forces designated by the arrows generally marked $F_x$. It should be noted that the toner particle 42, in this illustration, carries a positive charge. It should also be noted that the toner particle 42, as depicted in FIG. 4, always experiences a net hold down force, $F_y$, in one quadrant where $F_x$ is positive.

It is possible for a particle to experience either positive or negative forces depending on its phase and position relative to the traveling wave. At "slow" speeds, the particle can be expected to sit at the zero-crossing at point B. There is a simple restoring force which tends to hold the particle at that position. The other zero-crossing at point D is an unstable equilibrium point. As the drive speed is increased, the particle 42 will lag behind the zero-crossing in a region where there is positive drive force. When this lag exceeds $kx=\pi(x=\lambda/2)$, the force becomes negative, and the particle 42 slips phase and no longer moves synchronously with the traveling wave. In steady state, the magnitude of the lag is determined by a balance between the drive force and any drag present, and aerodynamic drag is usually believed to dominate.

3. Optimization ff Transport Parameters

As mentioned above, the print head 36 illustrated in FIG. 3 is a physical device that approximates the behavior of such an ideal device. The print head 36 includes a series of electrodes 46 disposed on or near the transport surface, and these electrodes 46 produce voltages that approximate the ideal traveling wave. A dielectric layer, described below, is typically fabricated over the electrodes 46 to insulate and protect them. With this type of device in mind, there are four factors that may be used to describe any particular version of such a device: (1) the toner particle diameter; (2) the spatial wavelength of the traveling wave; (3) the electrode pitch, i.e., the number of electrodes per wavelength; and (4) the dielectric thickness.

It has been discovered that currently known traveling wave toner transport devices suffer from certain problems related to toner transportation. For instance, the devices provide jerky control of the toner motion, thus making the creation of the desired image unduly difficult. Also, the toner particles move at a rate of less than 200 millimeters per second on existing devices, while toner velocities of approximately 1 meter per second are needed to produce a printer capable of printing 20 pages per minute.

With these problems in mind, the relationship of these factors may be optimized to provide a print head 36 that produces reliable packet motion at more useful speeds. The maximum drive force is obtained for a wavelength of approximately 4.25 times the particle diameter. The wavelength range of 3.0 to 4.5 times the average particle diameter provides particularly good results, although improvements may be seen from 2.0 to less than 12.0 times the average particle diameter. The dielectric thickness is of relatively minor importance, however, because it is generally possible to increase the amplitude of the drive voltage on the electrodes 46 to compensate for the dielectric thickness. Of course, since it is usually desirable to operate at the lowest possible voltages, the optimum dielectric thickness exhibits a dielectric breakdown strength that is just sufficient to withstand the peak drive voltages. The maximum drive voltage is then limited by the onset of Paschen discharge in the air over the device. Also, a thinner dielectric layer may be used if lower speed operation is targeted.

It should be noted that it is not always best to choose a wavelength that provides maximum drive force, because the maximum drive force varies by only about 10% for a wavelength range of 2.5 to 8.8 times the diameter of the toner particles 42. This force determines the maximum particle transport speed along the device, which is limited by air drag on the particle 42. However, since there is typically one toner packet 48 per wavelength, the net toner throughput is inversely proportional to the wavelength. In fact, toner throughput may actually be even higher because, for longer wavelengths, toner packets 48 may consist of two or more rows of toner particles 42. However, wavelengths where only one row of toner particles 42 fits, i.e., wavelengths less than about 7 toner particle diameters, are typically advantageous because maximum gray scale resolution can then be obtained. Thus, within a range of wavelengths where the force is varying slowly, the shortest wavelength will generally give the maximum net toner throughput. Of course, the existence of particle size distributions in real toners typically dictates that a slightly larger wavelength should be used so that the largest toner particles 42 present in significant numbers receive adequate drive force. Typically, for spherical (polymerized) toners, such as toner available from Nippon Zeon, which have relatively narrow size distributions, peak performance is achieved for wavelengths of about 3 to 4 times the average toner diameter.

In regard to the pitch of the electrodes 46, it should be noted that the discrete electrodes 46 produce fringe fields that may produce an uneven drive force. This phenomenon is in contrast to the magnetic drive forces that occur in ac motors and stepping motors, for example, where a stable position can be set anywhere in between the poles by putting intermediate currents into the coils on adjacent poles. Pure sine wave drives of the discrete electrodes 46 where the pitch of the electrodes 46 is similar to the diameter of the toner particles 42 tend to produce a jerky drive where toner particles 42 step from electrode to electrode. This phenomenon is especially noticeable at low speeds. It is possible to smooth this motion by setting the pitch of the electrodes 46, as measured between electrode centers, at less than the diameter of the average toner particle 42. It is believed that a pitch of less than about half the particle diameter produces particle motion that is indistinguishable from that of an ideal traveling wave, but pitches between one half and one diameter are usable as well. For instance, if the wavelength is 3 to 4 diameters, and the pitch is about a half diameter, then at least 6 to 8 electrodes per wavelength are used to produce a smooth drive.

It is possible to construct discrete electrode configurations with various spatial duty cycles (ratio of electrode width to pitch). However, the dominant mechanism that produces jerky motion is simply the pitch-to-particle diameter ratio as described above and not image forces, at least for typical toner charge levels. Thus, varying the spatial duty cycle produces little effect. Therefore, it is typically advantageous to use equal width lines and spaces for ease of manufacturability.

In general, it is convenient to use an even number of electrodes per wavelength, because the drive circuitry is simpler in that half the phases are direct inverses of the other half. Thus, a six-phase drive at a wavelength of 3 to 4 times the average particle diameter is found to be a simple configuration that produces a reasonably smooth traveling wave drive and good packet throughput. Such a drive configuration gives more stable motion of the toner packets 48 at all speeds, thus minimizing the risk of packet breakup during acceleration, for example, as well as higher maximum operating speeds than a three-phase drive configuration at the same wavelength. More phases are clearly possible, at least within the resolution limits of the manufacturing technology adopted, but more phases may not gain significant practical advantage over a six-phase drive scheme.

4. Transport Device Construction and Pixel Formation

Although the manner in which the toner particles 42 are transported on the surface of the print head 36 has been discussed in great detail above, it should not be forgotten that the toner particles 42 are to form pixels. Accordingly, the print head 36 includes a plurality of rails 60 that extend along the surface of the print head 36 perpendicular to the plurality of electrodes 46, as illustrated in FIG. 3, to form a ladder array 63. In one embodiment, the rails 60 are separated by the width of a single pixel so that the packets 48 of toner particles 42 are approximately one pixel wide. For example, the rails 60 have centers placed approximately 42 microns apart to produce a 600 dot per inch (DPI) printer. Thus, if the diameter of the toner particles 42 is approximately 8 to 12 microns, 3 to 5 toner particles 42 may be placed side by side in each channel 62 to form a packet 48. In accordance with another embodiment, the rails 60 may be spaced apart at some fraction of a pixel width to form smaller transport channels to increase the control of the toner used to form a single pixel. In keeping with the example of a 600 DPI printer, one embodiment of the print head 36 might use rails 60 on 21 micron centers to create channels 62 that are approximately one half of a pixel width wide. This sub-pixel spacing would increase the control of toner flow at the expense of a reduction in net throughput of the print head 36. Also, if the toner particles 42 are launched in single particle packets, the mutual repulsion between toner particles in multi-particle packets would be eliminated. Thus, the toner spread during transfer across a gap caused by such repulsion also would be eliminated, causing the resolution of the pixel formed by the single particle packets to improve. Two particle packets would provide the next best resolution, and so on.

Figure 5:
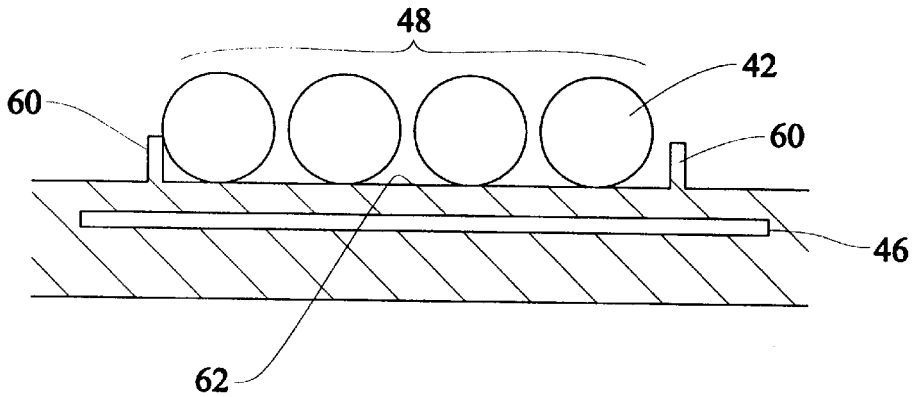
FIG. 5 illustrates a cross-sectional view taken along line 5—5 of FIG. 3.

As mentioned above and as explained in detail below, the electrodes 46 are typically covered by a suitable layer of dielectric material on which the toner particles 42 move. However, the rails 60 may extend above the surface to form actual physical barriers which tend to keep the packets 48 of toner particles 42 within the respective channels. One such embodiment is illustrated in FIG. 5, which is a cross-sectional view taken generally along line 5—5 in FIG. 3. In this embodiment, the rails are typically from 3 to 8 microns in height, though generally it is thought that heights between 40 and 60 percent of the diameter of the toner particles 42 is typically sufficient to restrain the packets 48 of toner particles 42 within the channel 62. In one embodiment, the rails 60 illustrated in FIG. 5 are made of a dielectric material. The rails 60 may be formed, for instance, by covering the electrodes 46 with a relatively thick layer of dielectric material and etching through portions of the dielectric material to produce the channels 62 defined between the dielectric rails 60. Alternatively, a layer of dielectric material may be fabricated over the electrodes 46 and then covered with an appropriate mask, such as a layer of photoresist. Once windows have been masked and etched in the layer of photoresist (not shown) dielectric material may be deposited over the layer of photoresist and into the windows in any suitable manner, such as by sputtering or chemical vapor deposition to create the rails 60. After the rails 60 have been created, the layer of photoresist may be removed in any suitable manner, such as by a piranha etch or an ash process.

Figure 6:
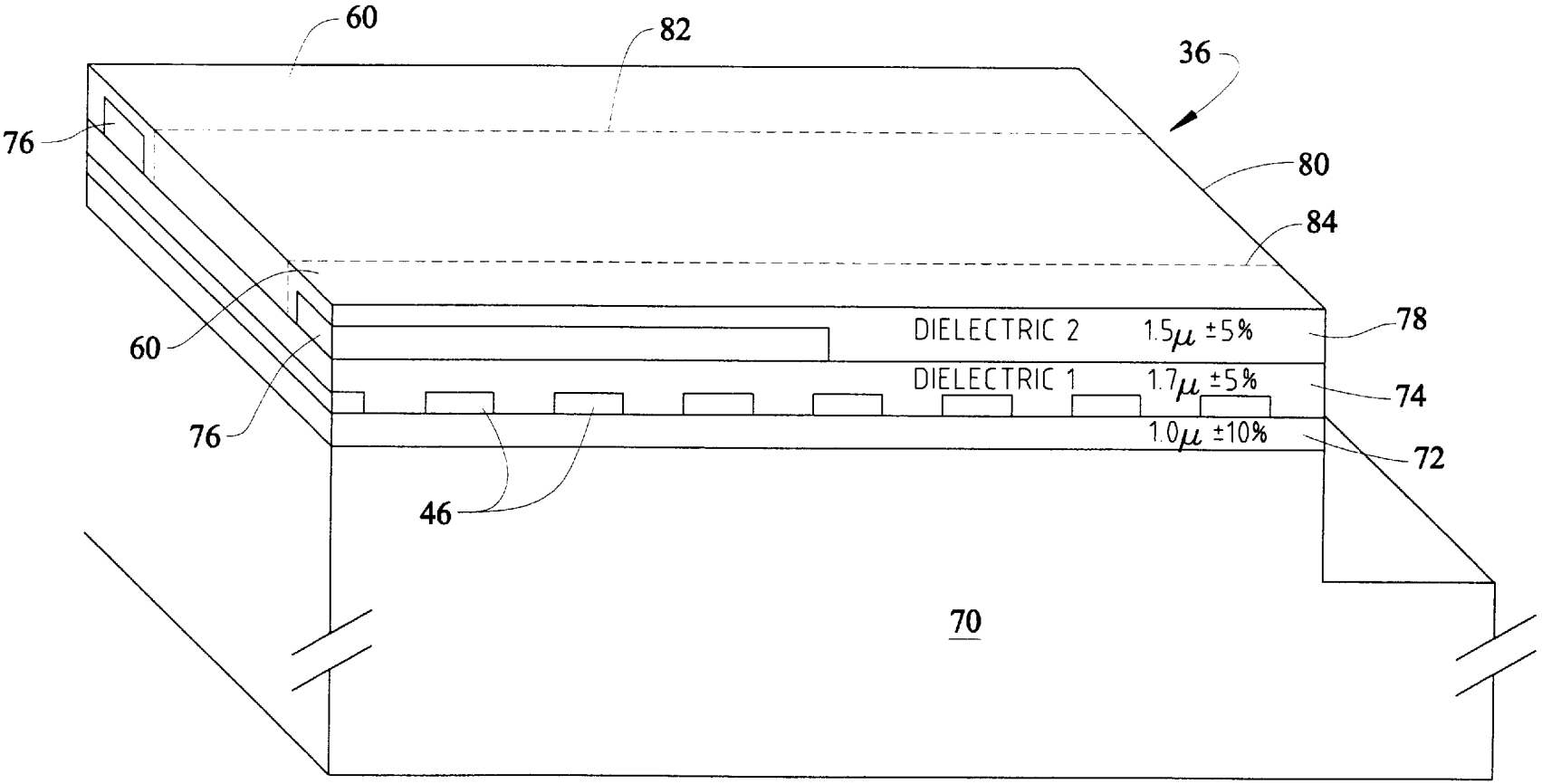
FIG. 6 illustrates a perspective view of a portion of a print head having a traveling wave transport surface.
Figure 7:
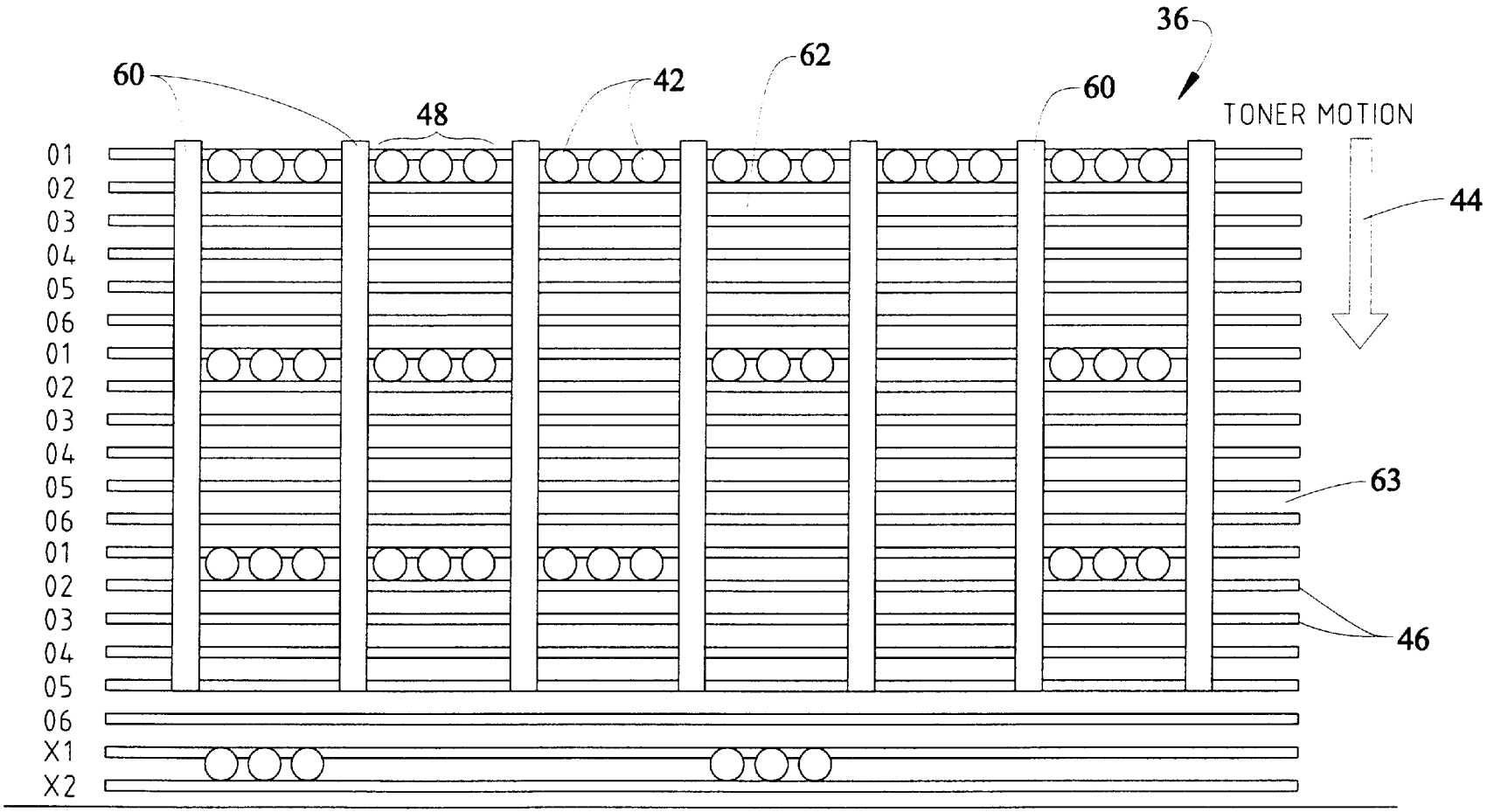
FIG. 7 illustrates an embodiment of a print head surface having channel-defining rails that terminate before reaching the launch end of the print head.

In an alternate embodiment, the rails 60 may be formed of electrically conductive material, such as a suitable metal or polysilicon. In this embodiment, the rails 60 may have an appropriate voltage (e.g., 50 to 100 volts) applied to them to create divider electrodes near or on the top surface of the print head 36. The fabrication of these divider electrodes is described along with the other features of an embodiment of the print head 36 illustrated in FIG. 6. As can be seen in FIG. 6, the primary structures of the print head 36 are fabricated on a suitable substrate 70, such as a silicon wafer. A layer of dielectric material 72, such as silicon oxide, is formed on the substrate 70. The layer of dielectric material 72 primarily prevents the subsequently deposited electrodes from interacting electrically with one another through the substrate 70. Of course, if the substrate 70 is made of an insulative or dielectric material, such as glass, the dielectric layer 72 may be redundant.

The traveling wave electrodes 46 are formed over the layer of dielectric material 72. Although the electrodes 46 may be fabricated by any suitable method, a layer of photoresist (not shown) may be applied to the surface of the dielectric layer 72 and etched to form windows where the electrodes 46 are to be formed. A layer of conductive material, such as a suitable metal or polysilicon, is then deposited over the layer of photoresist and into the windows. The layer of conductive material formed over the photoresist may be removed by a suitable etch or by chemical mechanical planarization, and the photoresist may then be removed to form the electrodes 46.

Alternatively, a layer of conductive material may be deposited over the layer of dielectric material 72, and a layer of photoresist (not shown) may be deposited over the layer of conductive material. The photoresist may be developed and etched to form windows which define the areas between the subsequently formed electrodes 46. A suitable etch may be performed to remove portions of the layer of the conductive material that has been exposed through the windows, and the remaining photoresist may then be removed to leave the electrodes 46 on the surface of the dielectric layer 72.

Once the traveling wave electrodes 46 have been formed, a layer of dielectric material 74 is deposited over the electrodes 46. The divider electrodes 76 are then deposited over the layer of dielectric material 74 in any suitable manner, such as the methods previously described as being used to form the electrodes 46. A layer of dielectric material 78 is then deposited over the divider electrodes 76. The divider electrodes 76, in this embodiment, do not protrude above the surface of the print head 36. Rather, the divider electrodes 76 are biased to repel the charged toner particles 42 in the packets 48 and, thereby, create voltage barriers between adjacent channels 62. It should also be appreciated that other structures that are not shown, such as bus electrodes and interconnections, may be formed during the described fabrication processes.

The repulsive fields near these divider electrodes 76 do exhibit certain apparent disadvantages, as compared to the raised dielectric rails 60, in that they may reduce the number of particles that can move together in a packet, and they tend to exert lateral forces on some of the toner particles 42 as they leave the end 80 of the print head 36. The reduced packet size tends to lower the maximum toner throughput of the process, and the lateral forces tend to deflect some of the toner particles from the desired straight-line trajectories. Accordingly, for these reasons, the dielectric rails 60 which extend above the surface of the print head 36 to create physical rather than electrical barriers may be advantageous.

To address one of these apparent disadvantages, the divider electrodes 76 may be terminated before they reach the launch end 80 of the print head 36 as illustrated in FIG. 6. This early termination significantly reduces the lateral scatter of the toner particles 42 at the launch end 80. In fact, it is believed that the lateral forces exerted on the toner particles 42 by the divider electrodes 76 are reduced by a factor of about 100 when the divider electrodes 76 are terminated before the last electrode 46. However, if the divider electrodes 76 are terminated just before the last electrode 46, e.g., on the next to the last electrode 46, the toner particles 42 closest to the divider electrodes 76 tend to receive a larger forward driving force. This larger force may result in these toner particles having trajectories different than the trajectories of the interior toner particles. Therefore, it may be advantageous to terminate the divider electrodes 76 on about the third or fourth electrode 46 before the end 80, as illustrated, to avoid this phenomenon, but the earlier the divider electrodes 76 terminate the more distance the toner particles 42 will have to spread laterally due to other factors, such as their mutual repulsion, surface defects, and fringe fields.

As yet another alternative, rails 60 having divider electrodes 76 which extend above the traveling surface of the print head 36 may be created. For instance, once the dielectric layer 78 has been formed over the divider electrodes 76, a portion of the dielectric layer 78 between the divider electrodes 76 may be removed to create a rail 60 that extends above the surface of the print head 36. Such rails are depicted in FIG. 6 by the dotted lines 82 and 84, with the understanding that the dielectric material 78 between the dotted lines 82 and 84 is removed, as discussed above, by any suitable method.

It has been found that the surface of the print heads along which the toner particles travel tends to be rough, sticky, or incapable of holding a neutral charge relative to the toner particles, thus hampering the ability of the device to transport the toner particles properly. Also, the materials and methods used to fabricate the print heads may determine an upper limit on the voltage differential that may be applied between phase lines, thus limiting the force that can be used to overcome toner sticking. Accordingly, the surface of the print head 36 on which the toner particles 42 move may be optimized to enhance the speed and controllability of the toner particles 42.

In view of the embodiments discussed above, the surface of the print head 36 on which the toner particles 42 move may be either the dielectric layer 74 or the dielectric layer 78. However, to facilitate the following discussion of the surface characteristics, we will use as the example the dielectric layer 74 which covers the electrodes 46. First, a discussion of the structural characteristics of the surface of the dielectric layer 74 is in order. It should be appreciated that, in the embodiments described above, the electrodes 46 protrude upwardly from the surface of the dielectric layer 72. Typically, the electrodes 46 are approximately 0.5 to 1.0 microns in height. Therefore, when the dielectric layer 74 is applied over the top of the electrodes 46, the surface of the dielectric layer 74 may exhibit a washboard effect. This washboard-type surface can disrupt toner motion.

To optimize transportation of the toner 42 across the surface of the dielectric layer 74, the surface of the dielectric layer 74 should be smooth. As one possibility, the dielectric material chosen for the dielectric layer 74 should be capable of providing a smooth non-conformal coating over the raised electrodes 46, while being thin enough to provide other advantages which will be discussed later. One particularly useful dielectric material is benzocyclobutene, which is sold by Dow Chemical Company under the tradename Cyclotene. Cyclotene may be applied over the electrodes 46 in any suitable manner, such as by spin coating or sputtering. The upper surface of the Cyclotene layer is quite flat even at thicknesses of about 0.5 microns over the electrodes 46.

As mentioned previously, the toner particles 42 carry an electrical charge. Certain dielectric materials used to fabricate the dielectric layer 74 may exhibit a charge exchange with the toner particles 42. Such a charge exchange causes the toner particles 42 to exhibit a tendency to stick to the dielectric surface 74. However, Cyclotene is particularly advantageous in that it readily reaches a state of charge equilibrium with toner so that the toner remains properly charged. Thus, due to the smooth, non-conformal upper surface of the Cyclotene, in combination with its properties which limit charge exchange, the toner particles 42 tend to move smoothly over the upper surface of the dielectric layer 74.

Although the Cyclotene does exhibit certain advantageous properties, other materials and/or techniques may also be suitable to produce a dielectric layer 74 having similar performance characteristics. For instance, dielectric materials that have rougher or more conformal surface characteristics may be used. These generally disadvantageous surface characteristics may be removed or minimized with an appropriate polishing process, such as chemical mechanical planarization. A smoother surface may also be created by a controlled etch or by a reflow process.

Of course, as discussed above, a smooth upper surface is only one advantage possessed by Cyclotene, the other advantage being its ability to limit charge exchange with the toner particles 42. To the extent that dielectric materials other than Cyclotene also possess such a characteristic, the use of such dielectric materials may be advantageous as compared to the use of other dielectric materials which do not exhibit such a characteristic. However, even certain dielectric materials which do not limit charge exchange with the toner particles 42 may also be suitable for use as the dielectric layer 74. If such dielectric materials are used, the performance of the dielectric layer 74 may be enhanced by precharging the surface of the dielectric layer 74 to inhibit charge exchange with the toner particles 42 by pre-establishing a state of triboelectric charge equilibrium between the surface and the toner.

Cyclotene also possesses another characteristic which makes it particularly advantageous for use as the dielectric layer 74. Specifically, Cyclotene exhibits a relatively high dielectric strength, sometimes referred to as dielectric breakdown, of approximately 300 volts per micron. The dielectric strength of the dielectric material 74 may be important because relatively high voltages may be applied to the traveling wave electrodes 46 to overcome the aerodynamic drag, which tends to inhibit the motion of the toner particles 42 along the channels 62, and to enable particles to accelerate from rest to catch the traveling wave.

5. Loading and Modulation of Toner Particles

To this point in the discussion the construction of the print head 36 and the manner in which the toner particles 42 move along it have been discussed, but the manner in which the toner particles 42 are loaded and modulated to form the desired images on a suitable print medium has not been discussed. It has been found that methods of modulating toner, i.e., controlling when and how much toner is provided by each channel, which have been disclosed to date are essentially unworkable. Accordingly, reference is now made to FIGS. 8–11 where four alternative apparatus and methods are illustrated for providing workable loading and modulation.

Figure 8:
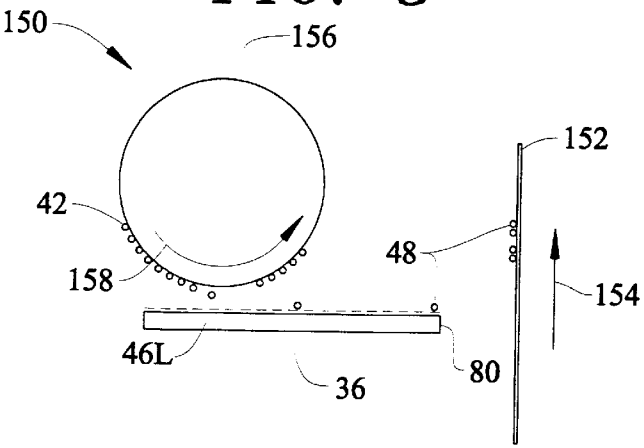
FIG. 8 illustrates a first embodiment of a loading/modulation scheme of the print engine.

Referring initially to FIG. 8, a first embodiment of a print engine 150 is illustrated. The end 80 of the print head 36 is positioned a suitable distance from a print medium 152, such as a piece of paper. The print medium 152 generally travels in the direction of the arrow 154. As can be seen, toner packets 48 are illustrated as being deposited on the print medium 152 to form a desired image. To control the print engine 150 to produce the desired image, a donor roll 156, such as those known in the art, is positioned a suitable distance away from the surface of the print head 36 across from the loading zone of the ladder array 63. The donor roll 156 rotates generally in the direction of curved arrow 158 and carries a plurality of toner particles 42 on its surface. The toner particles 42 are typically stored in a toner storage device 30 (FIG. 2) prior to being deposited onto the donor roll 156. The toner particles 42 tend to adhere to the surface of the donor roll 156 by image forces. A doctor blade (not shown) associated with the donor roll 156, or any other suitable mechanism, may be used to produce a relatively consistent layer of toner particles 42 on the surface of the donor roll 156.

As alluded to previously, and as described in greater detail below, the toner particles 42 are deposited into the channels 62 of the ladder array 63 near the end of the channels that is opposite the end 80. Because the toner particles 42 are charged, a variety of methods and mechanisms may be used to deliver toner particles near the loading end of the ladder array 63. These methods are generally similar to ac and dc development methods used in mono-component jump-gap development systems in conventional electrophotography.

To selectively load toner to form packets in an imagewise manner, a moving pattern of electrode voltages may be created for each channel 62. This will allow toner packets 48 to form inside the loading zone of the ladder array 63. The loading zone may be, for example, about 1 millimeter wide, which corresponds to about 30 wavelengths times 6 phases to equal 180 "loading" electrodes per channel 62. If this scheme were applied to a page width, e.g., 8.5 inch, print head, close to 1 million transistors and connections would be used to control packet formation in the loading zone. Due to the high voltages, e.g., 75 to 150 volts, currently used to accomplish loading and transport, this great number of high voltage transistors may be prohibitively expensive for the majority of possible commercial applications. Indeed, the number of connections used in this configuration may be cost prohibitive at any drive voltage.

The toner may be supplied by applying a combination of DC and AC voltage to a donor roll to cause the toner particles to detach from the donor roll and travel across the gap to the loading zone of the ladder array 63. This process is similar to the jump gap development of electrostatic images on photoreceptors in some laser printers, except here the latent image moves on a traveling electrostatic wave instead of a moving photoconductor surface. It should also be noted that the width of the loading zone should typically be larger than the distance that the packets move between successive cycles of toner deposition. For a given print speed of 10 pages per minute, for example, the paper speed would be about 2 inches per second, which corresponds to about 1200 pixels per second for 600 dpi printing. If about 8 packets per pixel are used to provide maximum color density, the print head would have to deliver about 9600 packets per second.

In jump gap development, the toner particles 42 are generally transported across a gap of about 300 microns using a 2000 Hz waveform. Thus, the traveling wave transports the toner packets 48 formed in the loading zone for about 0.5 milliseconds before the next wave of toner particles 42 arrive in the loading zone. During this time the toner packets 48 advance about 5 wavelengths, which corresponds to about 150–200 microns for wavelengths of 30–40 microns. Thus, the toner packets travel only a fraction of the width of the loading zone before the next toner packets are formed if the traveling wave drive frequency is about 10 k Hz.

Figure 9:
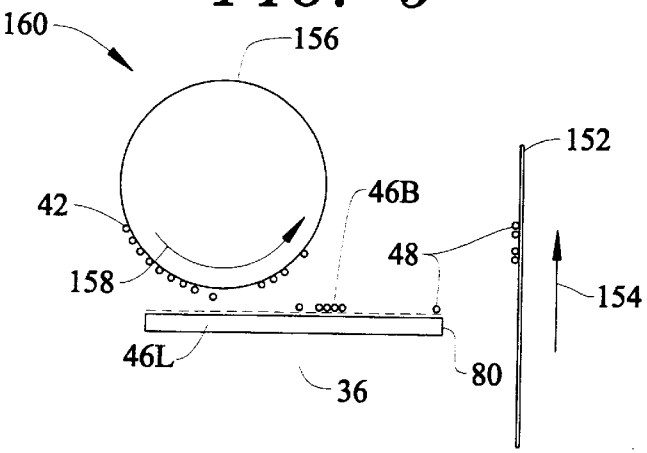
FIG. 9 illustrates a second embodiment of a loading/modulation scheme of the print engine.

FIG. 9 illustrates a system 160 similar to the system 150, so like reference numerals are used to designate similar elements to avoid confusion. Unlike the system 150, in the system 160, toner particles 42 are loaded in an unmodulated manner. As the toner particles 42 on the donor roll 156 move past the first phase 1 electrode at the upper end of the print head 36, the toner particles 42 are attracted onto the print head 36 once each phase. The toner packets 48 are then transported down the print head 36 toward the end 80 in an unmodulated manner as compared with the system 150 previously described in FIG. 8.

To provide appropriate modulation of the toner packets 48 in the system 160, the print head 36 illustrated in the system 160 includes one or more barrier electrodes 46B. When a barrier electrode 46B is energized, the toner packets 48 tend to stack up behind the barrier electrode 46B because the activation of the barrier electrode 46B prevents the toner packets 48 from being transported down the remainder of the print head 36. Because the barrier electrodes 46B may be used to control the modulation of the toner packets 48 on the print head 36, the simpler loading arrangement may be used to ensure that a given supply of toner packets 48 are being loaded onto the print head 36.

Figure 10:
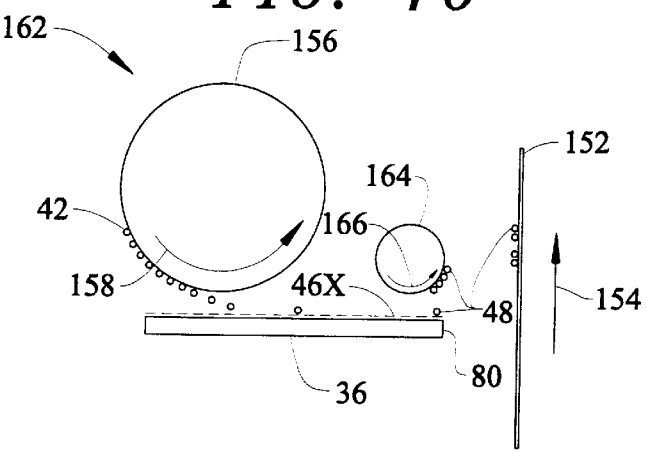
FIG. 10 illustrates a third embodiment of a loading/modulation scheme of the print engine.

Like the system 160, the system 162 illustrated in FIG. 10 is loaded in an unmodulated manner. However, in contrast to the system 160, the system 162 does not include any barrier electrodes. Rather, it should be noticed that the system 162 includes a pickup roll 164 that is positioned between the loading zone and the launch end 80 of the print head 36. The pickup roll 164 rotates generally in the direction of the curved arrow 166. It should be noted that the pickup roll 164 should not be placed too near the launch end 80, because the pickup roll 164 could disturb the electric field near the launch end 80.

Between the loading zone and the launch end 80 of the print head 36, one or more transfer electrodes 46X may be positioned rather than the typical traveling wave electrodes 46. If the toner packets 48 being transported across the transfer electrode 46X are not needed to form the image on the print medium 152, the transfer electrode 46X is activated to repel the toner packet 48 so that the pickup roll 164, which is biased to attract the toner particles 42, captures the unwanted toner packet 48. The unused toner is returned to a toner sump by means not shown, possibly jumping back to the donor roll 156 across a small gap. Alternatively, the modulation may also take place during transfer to the intermediate roll 172 of FIG. 11, and the unused toner may be returned to the sump by a means not shown.

The transfer electrodes 46X may be individually addressable electrodes in each channel (or in each pair of one-half pixel channels, etc.) which may be energized to transfer selected toner packets 48 to the pickup roll 164. The width of each transfer electrode 46X is advantageously about one-third to one-half the wavelength to ensure an effective disturbance of particle motion when activated, while not impeding toner motion when not activated. The transfer electrodes 46X may be formed as individual electrodes in each channel that are wider than the normal drive electrodes 46, or one or more electrodes having the same width as the drive electrodes 46 may be locally connected in each channel to create a transfer electrode 46X.

Figure 12:
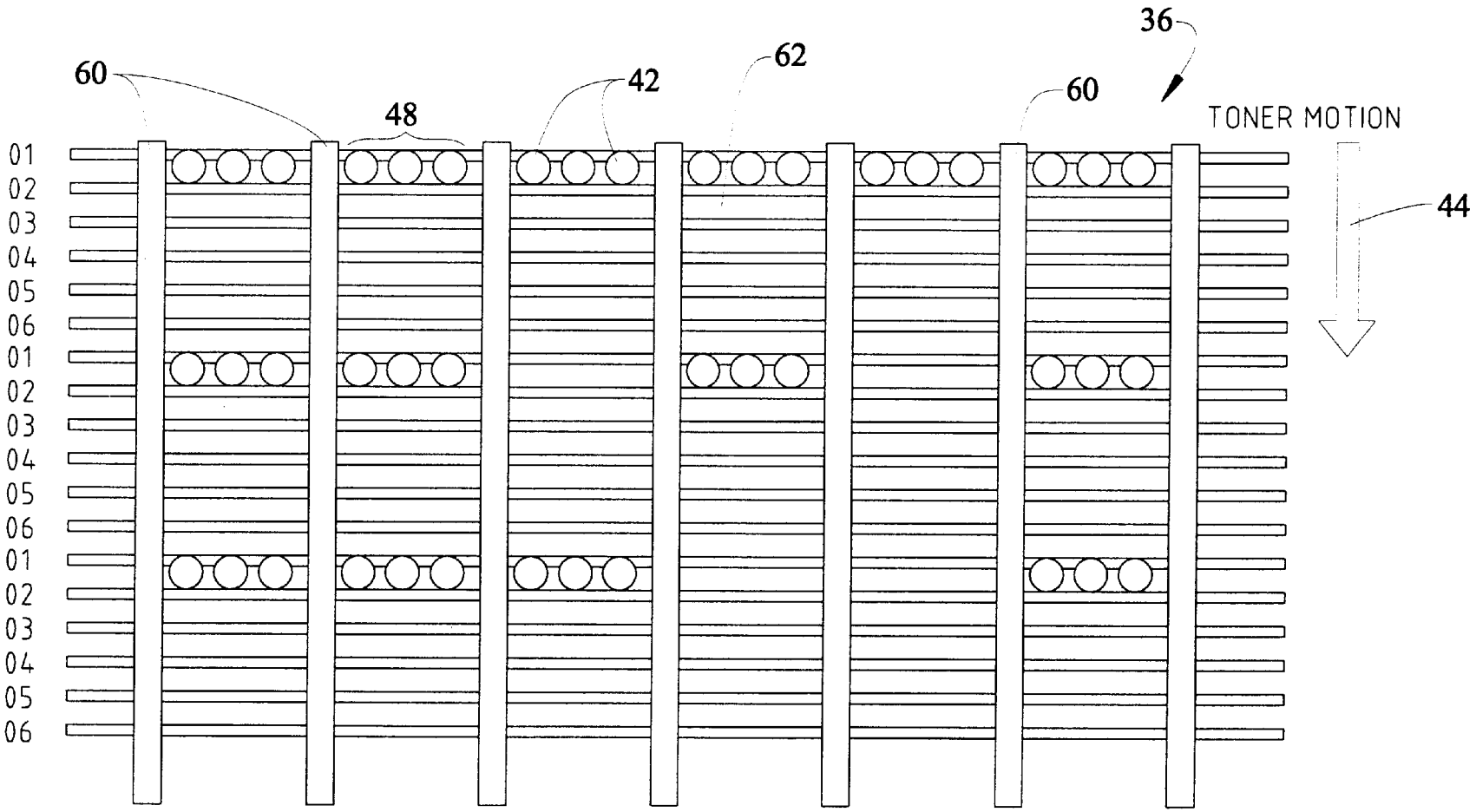
FIG. 12 illustrates a multiplexing scheme for use with transfer electrodes.

Because drive amplitudes may currently range from 100 to 300 volts peak-to-peak, relatively expensive high-voltage transistors are used in the drive circuitry. Thus, it may be advantageous to multiplex the modulation drive. One such scheme is illustrated in FIG. 12, where various transfer electrodes 46X are multiplexed by at least a 2-to-1 ratio. A common drive line (not shown) may be connected to two or more transfer electrodes 46X, where the modulation location of the transfer electrodes is staggered by 1/n wavelengths, with n being the number of pixels to be multiplexed. Since signals of the modulation line have an effect only when toner particles are over the corresponding transfer electrodes 46X, the staggered locations allow time-division multiplexing of the drive signals for the adjacent channels. In low-cost printer design, where net throughput is sacrificed in favor of cost, it is possible to increase the practical level of multiplexing by separating the toner packets 48 further to make more space for more transfer electrodes 46X per packet space. This can be done without increasing the drive wavelength by, for example, adding an additional full-width transfer electrode 46X that is modulated to remove every second toner packet 48 (or to leave every nth toner packet for even more space) from the entire print width.

Figure 11:
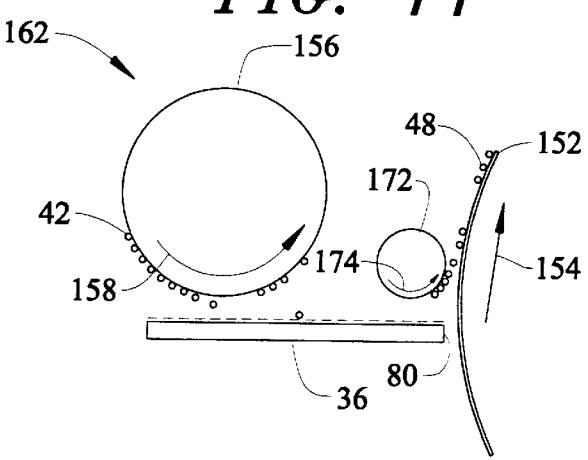
FIG. 11 illustrates a fourth embodiment of a loading/modulation scheme of the print engine.

Another alternative system 170 is illustrated in FIG. 11. In the previously discussed embodiments of FIGS. 8, 9, and 10, the toner packets 48 are transferred directly from the print head 36 to the print medium 152. However, in the system 170, a transfer roll 172 is positioned near the end 80 of the print head 36, much like the pickup roll 164 in the system 162. However, unlike the pickup roll 164, the transfer roll 172 picks up all of the toner packets 48 as it rotates generally in the direction of the curved arrow 174. These toner packets 48 have been modulated, by any appropriate means, such as by using the transfer electrodes 46X described above, so the toner packets 48 form an image on the transfer roll 172. The transfer roll 172 then transfers the toner packets 48 in a "conventional" manner, i.e., by contact, onto the print medium 152, which is illustrated as being positioned an appropriate distance from the transfer roll 172.

6. Print Head Types

Figure 13:
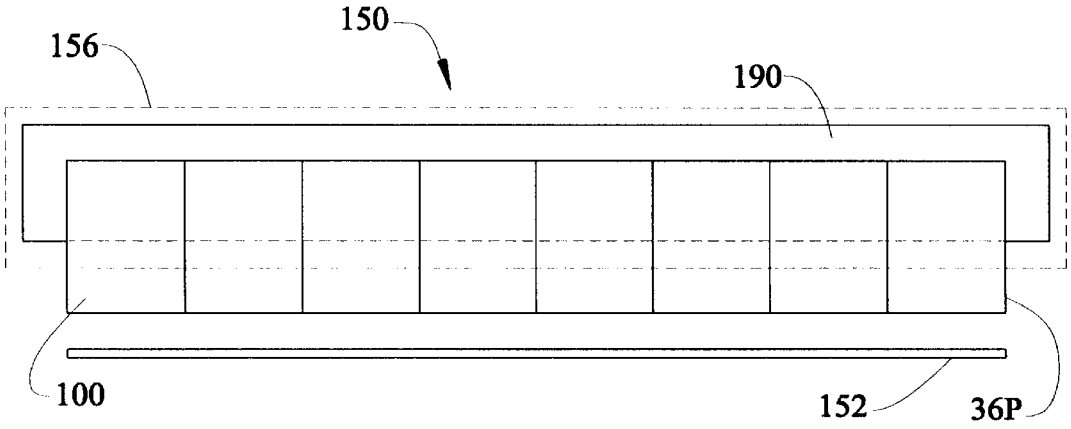
FIG. 13 illustrates a page wide print head as a top view of FIG. 8.

The print head 36 may include several chips mounted side by side to form a page wide print head 36P that is approximately the width of the print medium 152. For instance, FIG. 13 essentially illustrates a top view of the device 150 illustrated in FIG. 8 with the donor roll 156 illustrated in phantom lines. As illustrated, a plurality of chips 100 are coupled side by side by a carrier 190 to form the print head 36P that is approximately the width of the print medium 152. It is thought that a page wide print head 36P will maximize the potential throughput of the printer.

Figure 14:
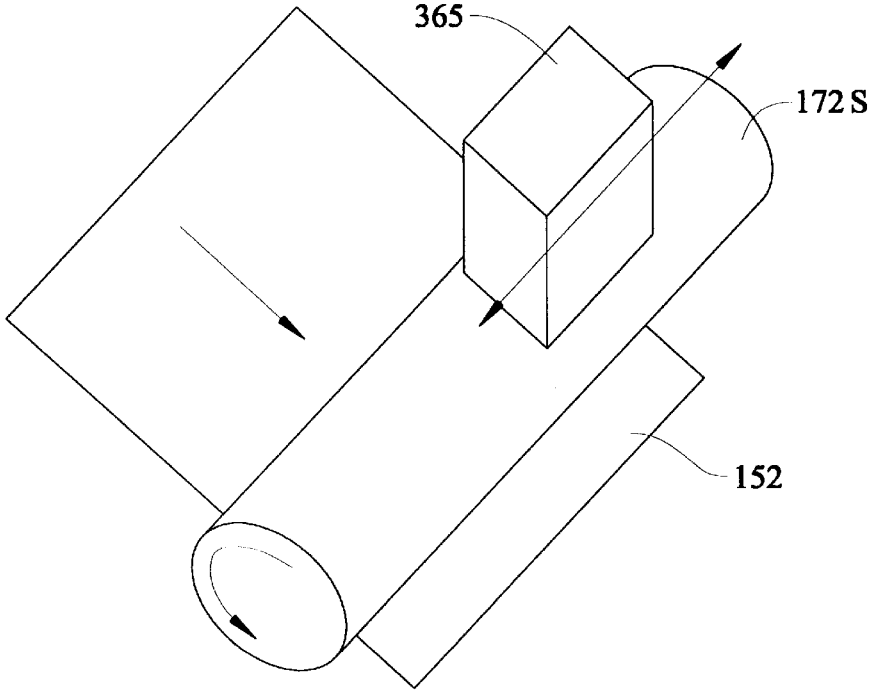
FIG. 14 illustrates a scanning print head, along with other portions of a print engine that uses the scanning print head.

Alternatively, as illustrated in FIG. 14, one or more chips may be coupled to a scanning device, such as a swathing print carriage similar to those known in the art, to form a print head 36S that scans across the print medium 152 to create the desired image. Although the use of a scanning print head 36S may reduce potential throughput, this type of scanning print head 36S nonetheless appears to offer various advantages as compared with the page wide print head discussed above. First, because the scanning print head 36S has many fewer channels and, thus, uses many fewer high voltage drivers, the scanning print head 36S is much less expensive than a comparable page wide print head 36P. Second, instead of "splicing" several chips, which are 1 to 5 centimeters in width, together to form a page wide print head 36P, a single chip may be used to form the scanning print head 36S. Third, because the relatively expensive driver circuitry may be contained elsewhere in the printer, the scanning print head 36S may be disposable, although it may be configured to be refillable in order to minimize the printing cost per page.

The scanning print head 36S may be positioned directly across a gap from the print medium 152, so that toner packets 48 are transferred directly onto the print medium 152. However, as illustrated in FIG. 14, the scanning print head 36S is advantageously positioned to write images onto an intermediate drum 172S. The intermediate drum 172S may be sized to accept the largest image to be accommodated by the printer, and its surface may be compliant to enhance pressure transfer onto the print medium 152.

The scanning head 36S may write images onto the surface of the intermediate drum 172S in a raster scan pattern. As one example, the scanning head 36S may be held stationary during a full rotation of the drum 172S to write an image around the circumference of the drum. The scanning head 36S may then be incrementally moved along a path parallel to the axis of rotation of the drum 172S to write the next image around the drum, and so on. Alternatively, the scanning head 36S may move along the width of the drum 172S as the drum remains stationary to write an image across the width of the drum 172S. The drum 172S may then be incrementally rotated by one or more scan widths so that the scanning head 36S may write the next line of the image. The scanning head may write in only one direction, termed as "unidirectional," or it may write in both directions, termed as "bidirectional."

Although the raster scanning methods described above may be used, the scanning print head 36S advantageously writes images onto the intermediate drum 172S in a continuous spiral pattern that makes one revolution for each swath width. This spiral writing approach may be significantly more efficient than the typical back-and-forth scanning devices used by most ink jet printers, which spend most of their time accelerating and decelerating. Indeed, the spiral writing approach may permit the scanning device to use a stepper motor having reduced torque and power requirements as compared with those used in ink jet printers. Furthermore, the scanning print head 36S may incorporate a small toner jet arrangement, rather than a small traveling wave toner transport device, because the spiral writing technique may also provide advantages for these types of printers. As an enhancement to the spiral writing method, it may be useful to rotate the print medium or the drum slightly to align the spiral pattern with the vertical or horizontal edge of the print medium to avoid aliasing problems with horizontal or vertical lines.

Once written on the drum, the image then may be transferred to the print medium 152 with one additional revolution of the intermediate drum 172S. The image may be subsequently fused to the print medium 152, or, in one particularly advantageous situation, a transfix mechanism (not shown) is used, thus transferring the toner to the print medium 152 with a combination of heat and pressure to fuse the image to the print medium simultaneously.

Figure 15:
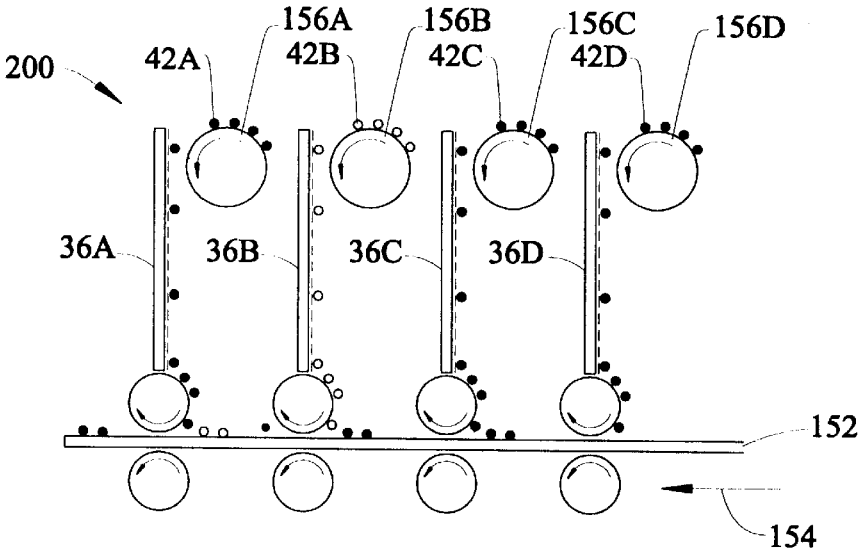
FIG. 15 illustrates an embodiment of the print engine for use with a color printer.

Furthermore, it should be appreciated that a separate print head 36 is used for each color of toner. Accordingly, in a color printer that uses black, yellow, cyan, and magenta toner, four separate print heads 36, along with the other associated mechanisms, are used. One such exemplary system 200 is illustrated in FIG. 15. The print head 36A transports black toner particles 42A from the donor roll 156A to the print medium 152, which is moving in the direction of the arrow 154. Similarly, the print head 36B transports yellow toner particles 42B from the donor roll 156B, the print head 36C transports cyan toner particles 42C from the donor roll 156C, and the print head 36D transports magenta toner particles 42D from the donor roll 156D. Of course, if a color printer uses scanning print heads 36S, two or more scanning print heads 36S may be used simultaneously to transfer toner onto the intermediate drum 172S to build the desired color image.

7. Electric Field at the Launch End of the Print Head

Figure 16:
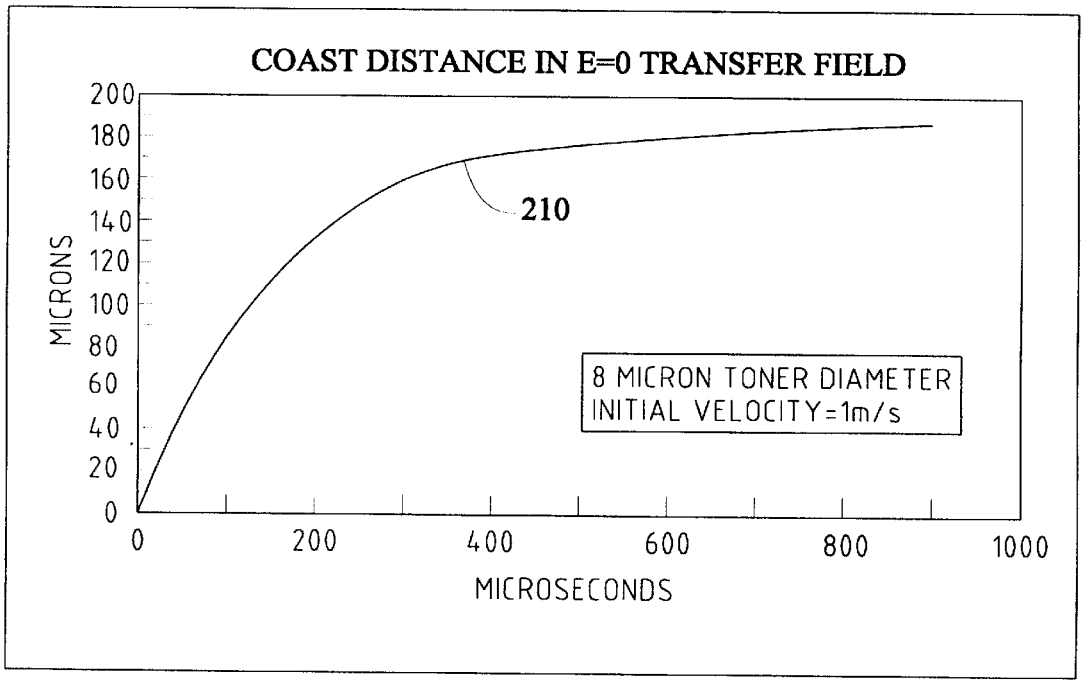
FIG. 16 illustrates a graphical depiction of the inertial motion of a toner particle in a transfer gap after leaving the end of the print head.

Although we have discussed various manners in which toner particles are loaded, transported, and modulated, we have not yet discussed in detail the manner in which toner particles are transferred to the print medium. Generally speaking, as illustrated in FIGS. 8, 9, and 10, the toner packets 48 may be transferred directly from the end 80 of the print head 36 to the print medium 152. Alternatively, as illustrated in FIG. 11, the toner packets 48 may be removed from the print head 36 by a transfer roll 172 and deposited onto the print medium 152 by the transfer roll 172. Focusing on the former transfer situation, it has been determined that the inertia of the toner packets 48, as they are transported along the print head 36, is generally insufficient to carry the toner packet across a transfer gap of 200 microns or more because of air drag. Indeed, it has even been found that, on currently known print heads, the toner particles often fail to "jump" off the end of the channels and onto the nearby paper, and, thus, these particles merely collect at the end of the channels. Assuming that the toner particles 42 are 8 microns in diameter and that they are moving at a velocity of 1 meter per second, the curve 210 illustrated in FIG. 16 demonstrates, through a numerical simulation, that a toner particle 42 quickly loses inertia due to air drag as it attempts to cross a 200 micron gap.

Figure 17:
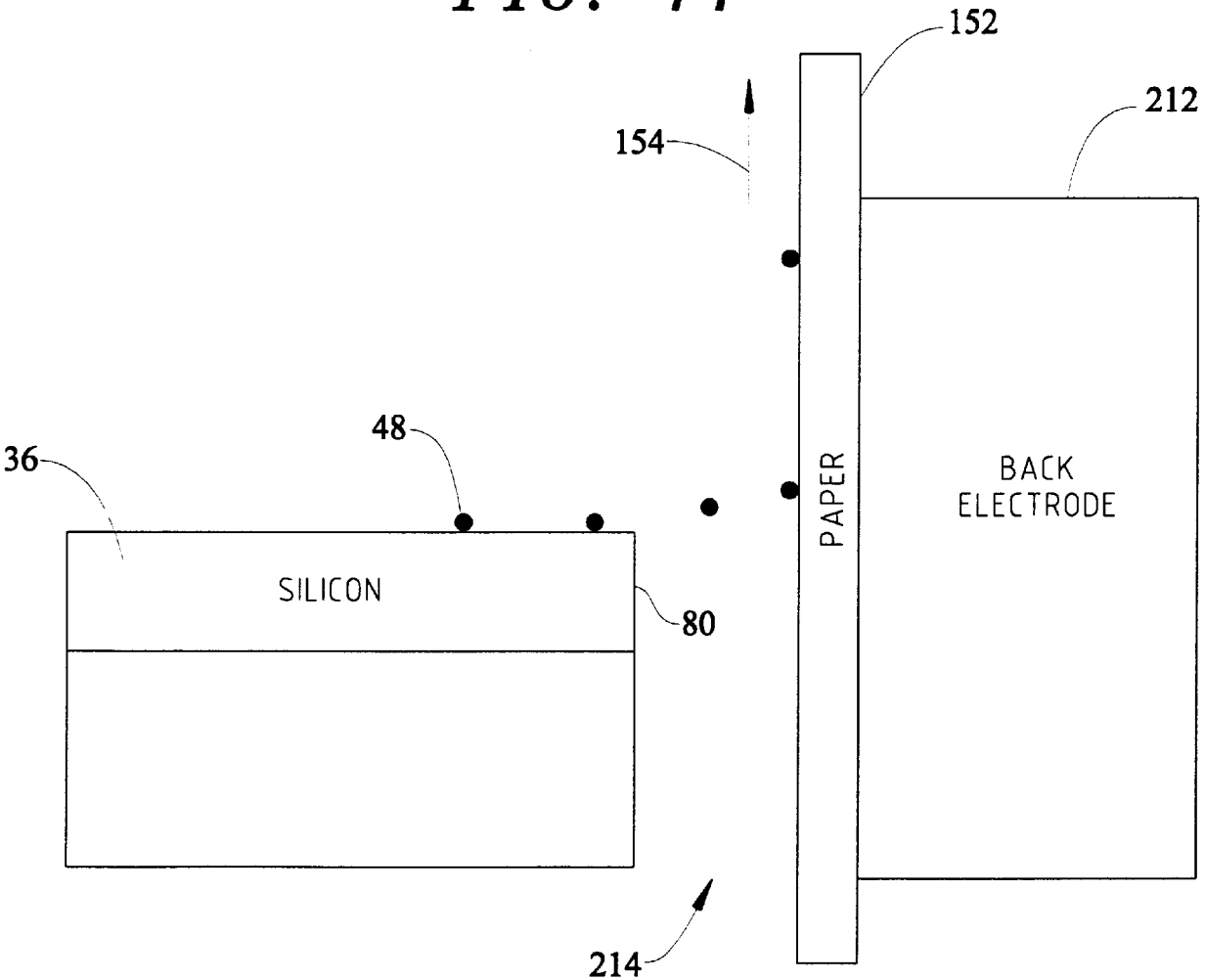
FIG. 17 illustrates a basic apparatus for facilitating transfer of toner from the print head onto a print medium.

However, because the toner particles 42 are electrically charged, an electric field may be applied across the gap 214 (see FIG. 17) between the end 80 and print medium 152 to help the toner particles 42 travel across the gap 214 and onto the print medium 152. One basic method of applying an electric field across the gap 214 involves placing an electrode 212 behind the print medium 152, as illustrated in FIG. 17. The electrode 212 develops a charge opposite that of the toner particles 42 to attract the toner particles 42 onto the print medium 152. Although, upon initial consideration, the electrode 212 would appear to be a clean and simple solution to transporting the toner particles 42 across the gap 214 between the end 80 and the print medium 152, it has been determined that the toner particles 42 tend to spread vertically, i.e., in a direction normal to the transport surface of the print head 36, as well as laterally, i.e., in a direction in the plane of the transport surface and normal to the dividers.

Figure 18:
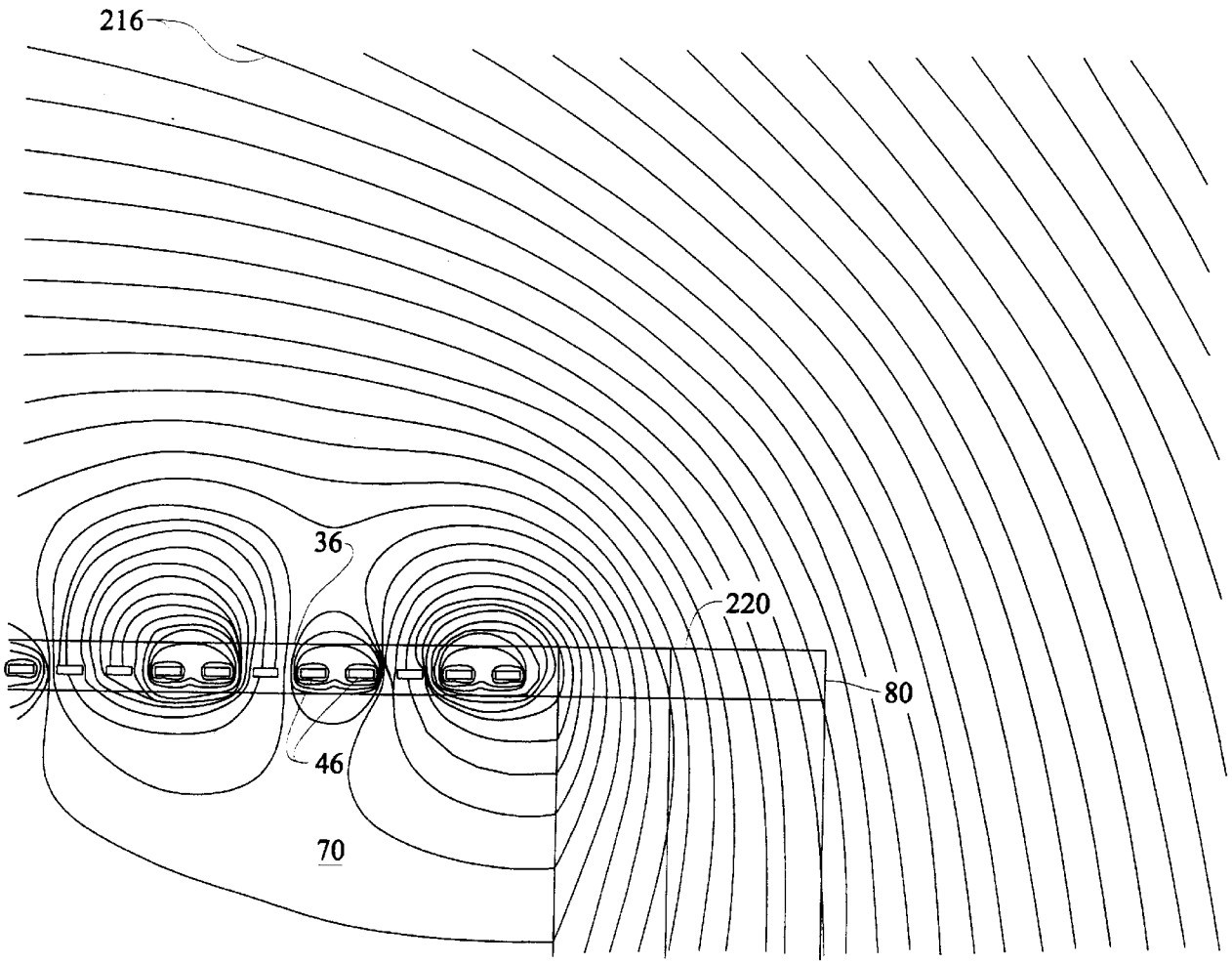
FIG. 18 illustrates an electric field produced by traveling wave electrodes near the launch end of the print head.

One of the factors responsible for such spreading is discussed in reference to FIG. 18. FIG. 18 illustrates the launch end 80 of a print head 36, including the last ten electrodes 46. As can be seen from the plurality of equipotential lines 216, the electric field produced by the electrodes 46 near the launch end 80 of the print head 36 tends to be quite divergent, as illustrated by the curvature of the equipotential lines 216, and, thus, contributes to variations in the launch angles of the toner particles which have various charge values and diameters. The ideal electric field at the launch end 80 and across the gap would be completely non-divergent or planar, so that it would essentially impart all toner particles with the same launch condition and initial trajectory.

Figure 19:
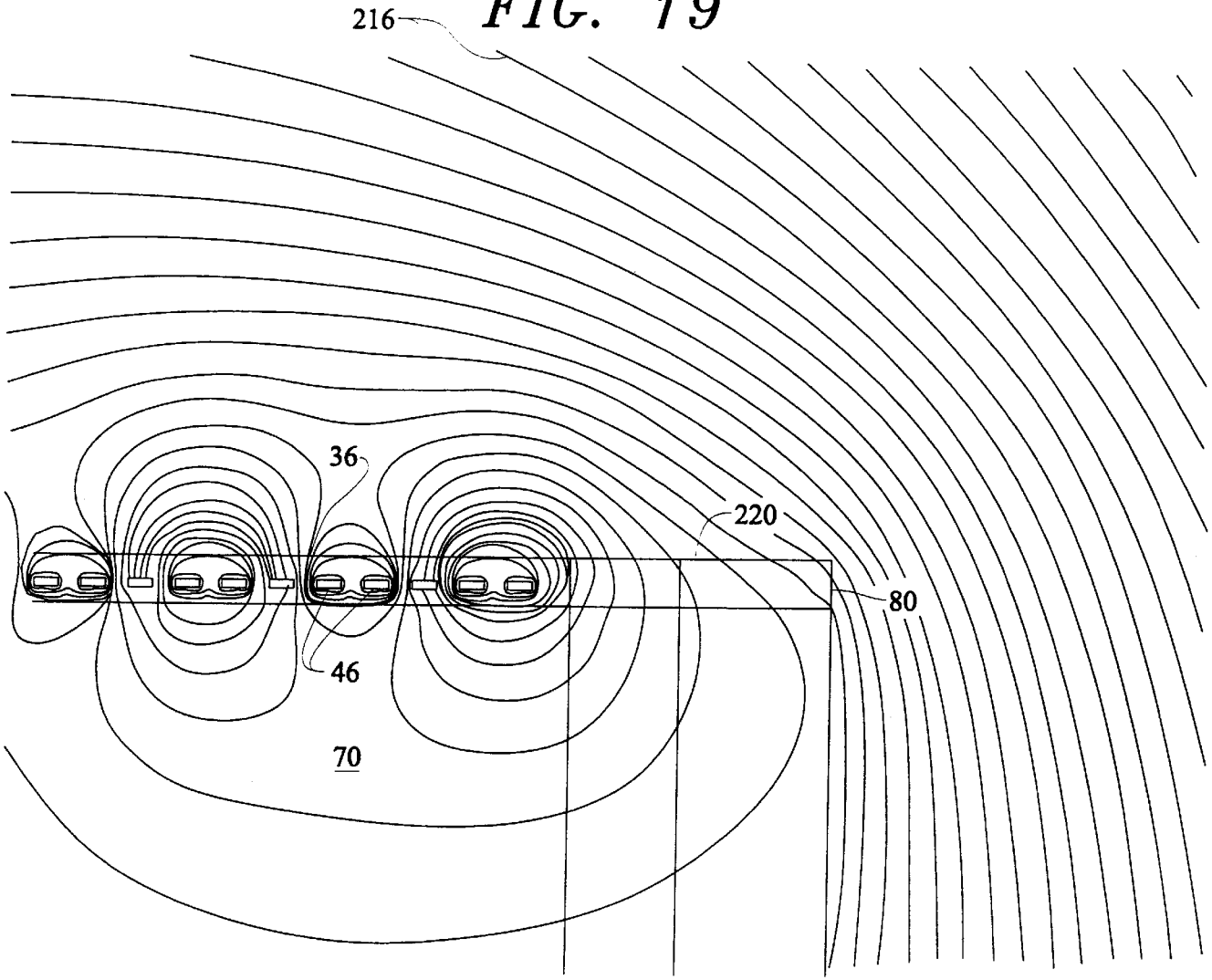
FIG. 19 illustrates an electric field produced by traveling wave electrodes near the launch end of the print head, where the launch end includes a dielectric runway.

Unfortunately, producing a planar electric field is quite difficult to accomplish because the electrodes 46 are responsible for producing the electric fields which transport the toner particles 42 along the surface of the print head 36. If the electrodes 46 are terminated too far from the launch edge 80, the toner particles 42 will tend to slow and stop. However, it has been determined that a dielectric runway 220 may be formed between the last electrode 46 and the launch end 80 of the print head 36, as illustrated in FIG. 19. By continuing the dielectric surface of the print head 36 several microns beyond the last electrode 46, the launch edge 80 of the print head 36 is distanced from the high field gradient and high intensity electric field surrounding the last electrode 46. Thus, the runway 220 provides a relatively "electrically smooth" area for the introducing of the toner particles 42 into the transfer field generated by the electrode 212. In this embodiment, the launch end 80 of the print head 36 is approximately 15 to 30 microns away from the last electrode 46. Clearly, the equipotential lines 216 near the launch end 80 of the runway 220 are much less divergent than the equipotential lines 216 near the last electrode 46.

It should also be noted that the toner particles 42 experience an attraction to the dielectric surface along the runway 220. This electrostatic attraction tends to hold the toner particles 42 against the runway surface until they reach the launch end 80. This electrostatic attraction is believed to be due to a local polarization of the runway dielectric in response to the charge on the toner particles 42. Since this attractive force is proportional to the dielectric constant of the material used to form the runway 220, it may be desirable to use a different dielectric material for the runway 220 than for the conveyor portion of the print head 36 in order to adjust the attractive forces to an optimum level. For instance, rather than using the Cyclotene dielectric layer 78 with a dielectric constant of 2.7, it may be desirable to use a dielectric, such as polyvinyl flouride or polyimide.

Figure 20:
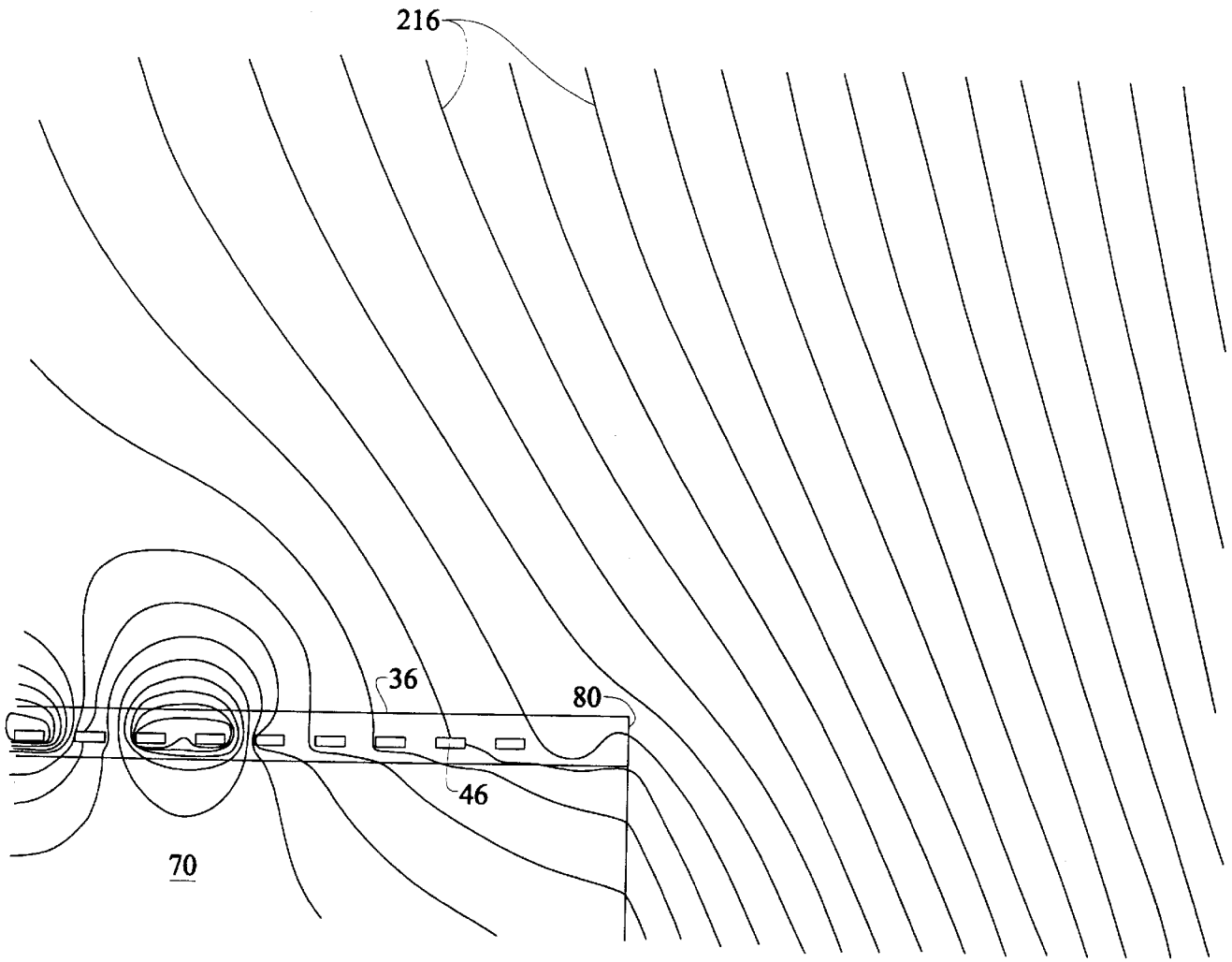
FIG. 20 illustrates an electric field produced by traveling wave electrodes near the launch end of the print head, where the traveling wave electrodes near the launch end are selectively controlled to shape and/or control the direction and amplitude of the electric field in the vicinity of where the toner particles leave the print head.

However, there are methods other than providing a runway devoid of electrodes for reducing the strength and/or divergence of the electric field at the launch end 80. In one alternative embodiment, illustrated in FIG. 20, the voltage waveforms applied to the last six electrodes 46, for instance, may be monotonically reduced in amplitude. The equipotential lines 216 in FIG. 20 depict the electric field near the launch end 80 of the print head 36 where the voltage amplitudes on the last six electrodes, i.e., one wavelength, are ramped linearly down to zero volts on the last electrode 46. Although the equipotential lines 216 in FIG. 20 exhibit more curvature at the launch end 80 than at the end of the runway 220 in FIG. 19, they still show a dramatic improvement over the curvature of the equipotential lines 216 at the launch end 80 in FIG. 18.

Figure 21:
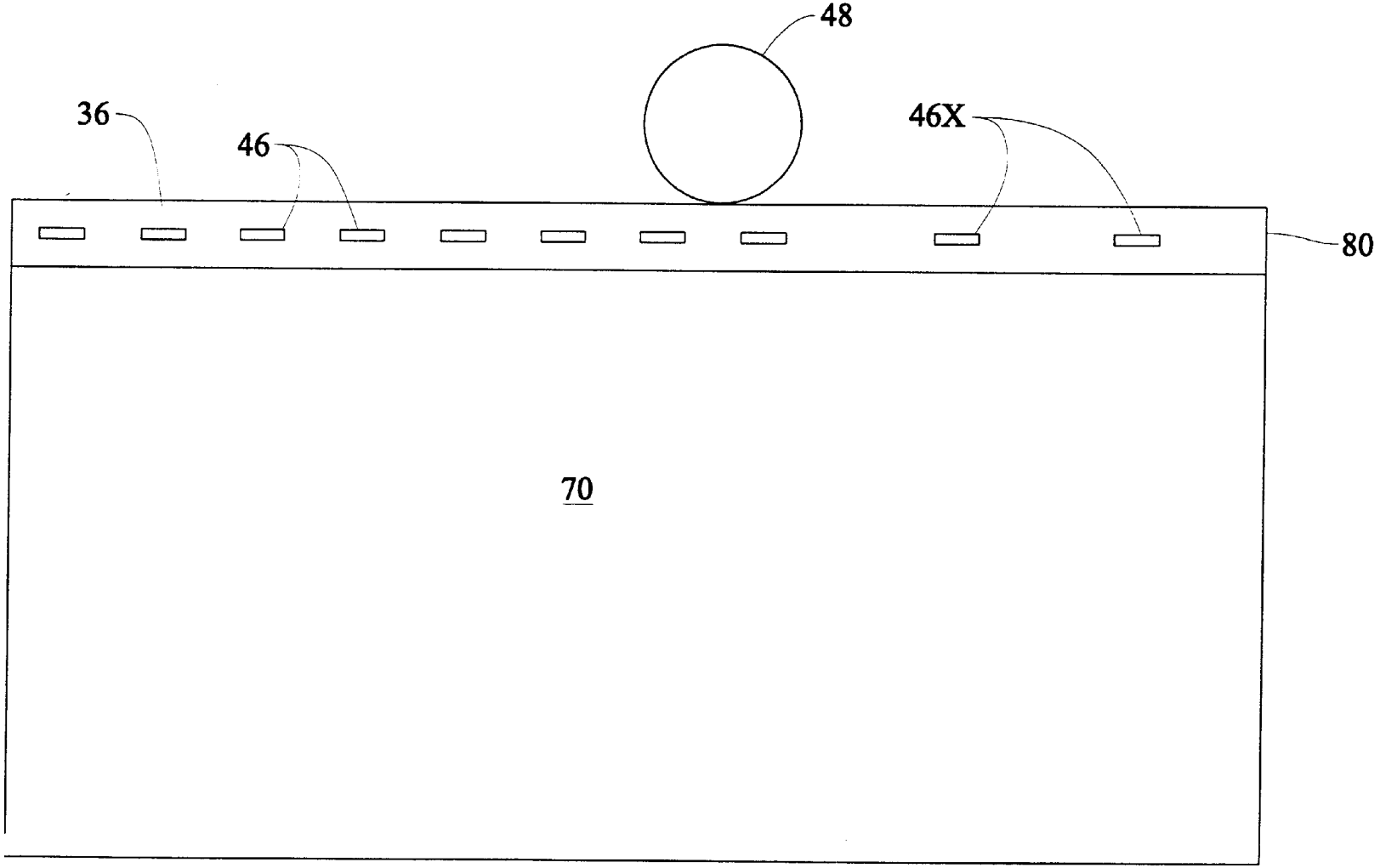
FIG. 21 illustrates a side view of the launch end of the print head including two transfer electrodes.

Although the alteration of the electric field in the transfer region as described with reference to FIGS. 19 and 20 may be advantageous, other methods and apparatus may be employed separately or in combination to further facilitate transfer of the toner packets 48 from the print head 36 onto the print medium 152. For instance, one or more transfer electrodes 46X may be used to help extract the toner packets 48 from the ac field created by the electrodes 46 of the traveling wave array. As illustrated in FIG. 21, the last two electrodes of the array 63 are transfer electrodes 46X that may be controlled independently of the traveling wave electrodes 46. The transfer electrodes 46X are illustrated as being spaced twice as far apart as the traveling wave electrodes 46. The larger spacing of the transfer electrodes 46X is theoretically useful, both for better separation of traveling wave fields and transfer fields and for accelerating the toner packets 48 for higher speed launch into the transfer region. However, the transfer electrodes 46X may be spaced at the same intervals as the traveling wave electrodes 46, because they can still serve to pull the toner packets 48 out of the ac field and shield the transfer region from that field. It may be advantageous to bias the transfer electrodes 46X such that they match the planarized field in the air immediately above them.

8. Focusing of the Electric Field in the Gap

The transfer of the toner packets 48 across the gap 214 between the print head 36 and the print medium 152 cannot only be facilitated by altering the electric field in the launch region in the ways discussed above, but the transfer can also be facilitated by modifying the target electrode configuration of FIG. 17 to include additional electrodes. These additional electrodes are arranged and energized to form an "electrostatic lense" that helps to focus and control the travel of the toner packets 48 across the gap 214.

However, before discussing any specific embodiments, a few properties of the electric field in the launch region should be discussed. It is believed that the toner particles 42 will decelerate if the transport field wavelength is less than or equal to about three times the particle diameter. Thus, near the end 80 of the print head 36, it may be desirable to use spatial wavelengths that are greater than about three times the diameter of the average toner particle 42. These variable field conditions extend with significant amplitude out to approximately one half the traveling wave wavelength into the gap 214. Thus, it may be advantageous to gain control over the variable direction of motion of toner particles 42 during that first one half wavelength of travel into a gap 214. Once beyond that distance, de fields should be sufficient to direct the further motion of toner particles 42.

Given these considerations, there are certain parameters that may facilitate the design of a suitable electrostatic lense. First, the electrostatic lenses should provide an electric field in the gap 214 that is, at most or all points, of similar magnitude to the peak field experienced by toner particles 42 as they move along the traveling wave, e.g., no more than a factor of about 4. Second, near the end 80 of the print head's surface, the electric field should be nearly parallel or even slightly converging to prevent particles from moving far off axis in the initial higher-field region. Third, there should be a significant focusing or restoring field tending to bring particles back to the axis at the target point on the surface of the print medium 152.

Figure 22:
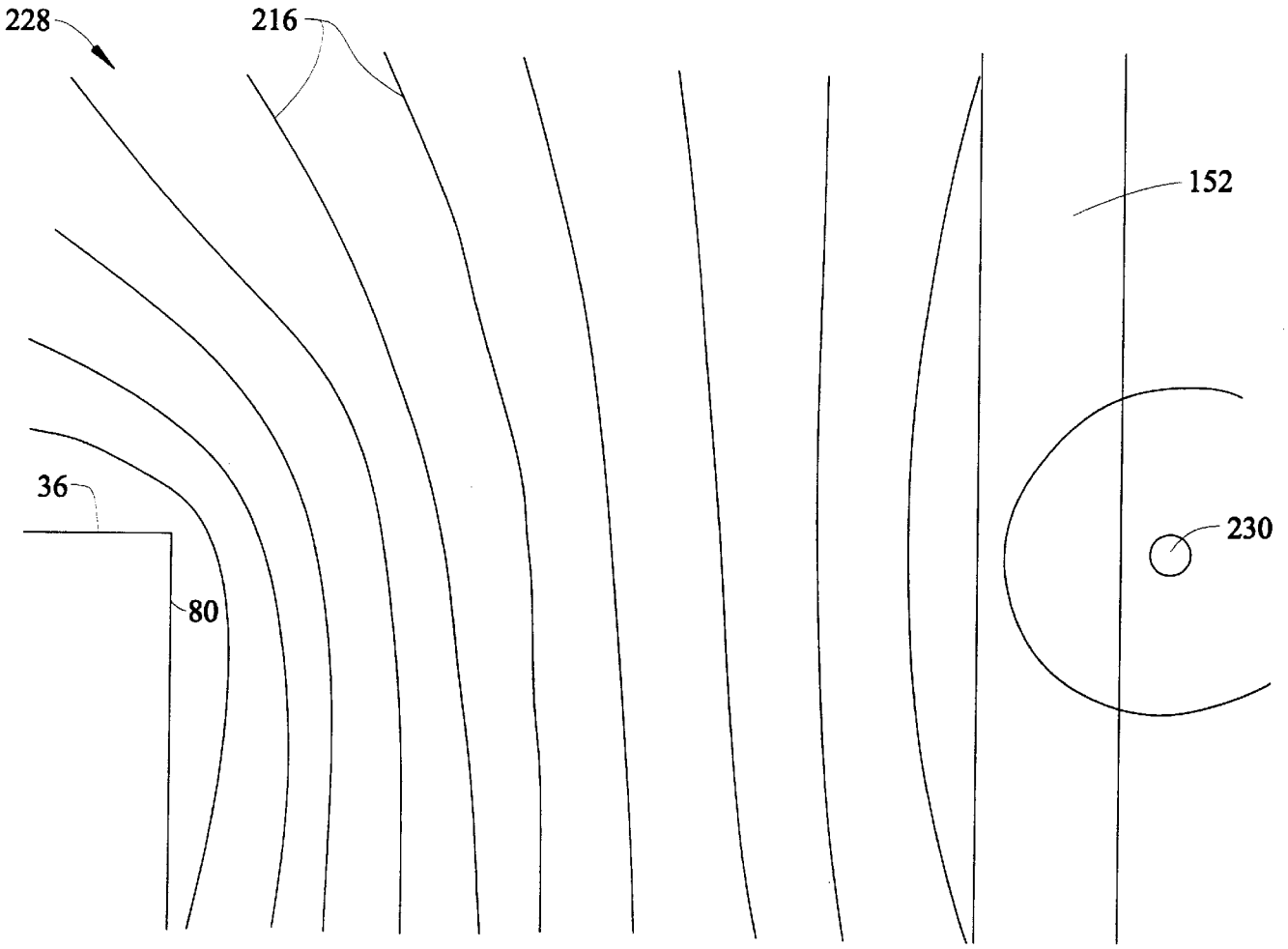
FIG. 22 illustrates an apparatus having a charge-concentrating target electrode for facilitating transfer of toner from the print head onto a print medium.

Various electrode structures may accomplish one or more of these goals. In the embodiment of the electrostatic lense structure 228 illustrated in FIG. 22, an electrode 230, which is capable of concentrating the electric field, is placed behind the print medium 152. The electrode 230 may resemble a knife edge or a wire, for instance. In contrast to the somewhat planar electrode 212, it will be appreciated that the electrode 230 will provide a much more concentrated field for attracting the toner particles 42. Although the resulting field still might contain outward components as the toner particles 42 leave the end 80 of the print head 36, the field will also contain inward focusing components in the last portion of the gap 214.

Figure 23:
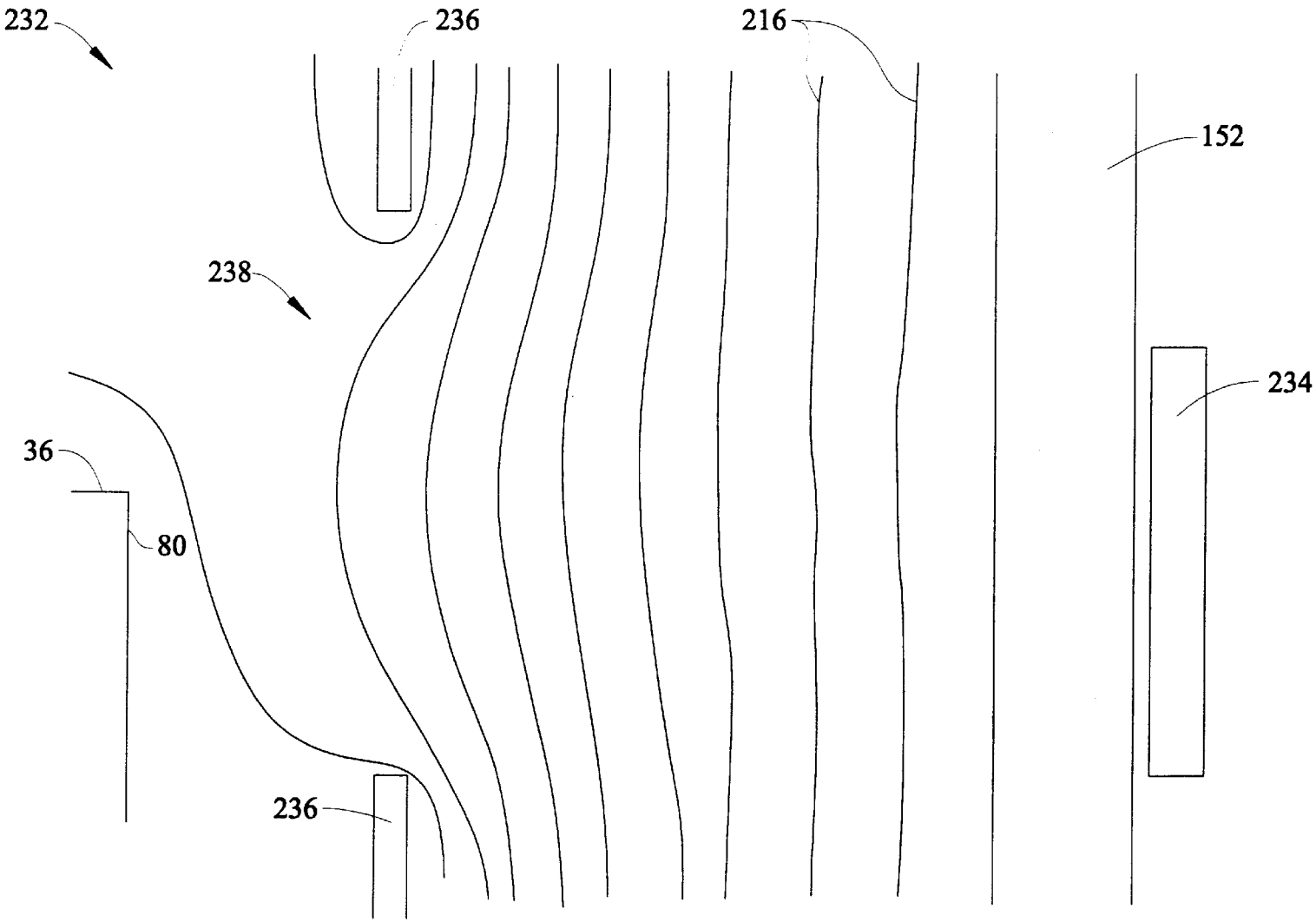
FIG. 23 illustrates an apparatus having a slit electrode for facilitating transfer of toner from the print head onto a print medium.

FIG. 23 illustrates another electrostatic lense structure 232. The lense 232 includes a target electrode 234, which may be similar to the field-concentrating electrode 230 or the planar electrode 212. Regardless of the type of target electrode used, however, a slit electrode 236 is interposed between the print head 36 and the print medium 152. The slit electrode 236 is charged opposite the target electrode 234 so that it focuses the toner particles 42 by repulsion as they pass through the slit 238. After passing through the slit 238 in the slit electrode 236, toner particles experience a focusing and attractive field as they continue toward the print medium 152.

Figure 24:
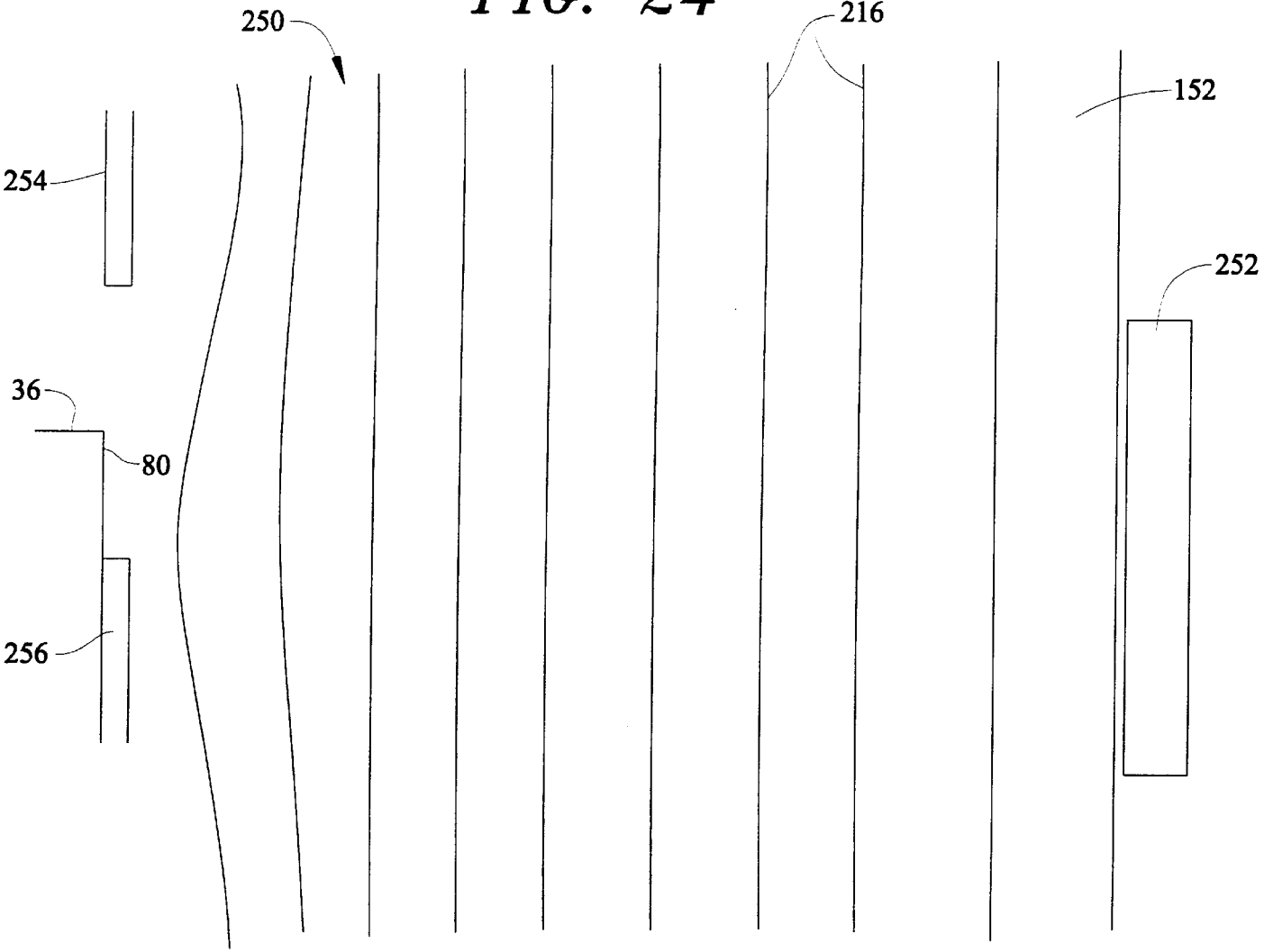
FIG. 24 illustrates an apparatus having planarizing electrodes for facilitating transfer of toner from the print head onto a print medium.

Another embodiment of an electrostatic lense 250 is illustrated in FIG. 24. Like the lense 232, the lense 250 includes a target electrode 252, which may be similar to the field-concentrating electrode 230 or the planar electrode 212. Regardless of the type of target electrode used, however, a pair of electrodes 254 and 256 may be placed near the end 80 of the print head 36 to shape the electric field near the launch site of the toner particles. These electrodes 254 and 256 may be flat or curved. The shape of the electrodes 254 and 256 and/or the voltage on them may be adjusted to achieve a parallel or slightly converging electric field near the end 80 of the print head 36 with an appropriate magnitude to prevent the above-mentioned undesirable end effects and launch behaviors. Typically, the electrodes 254 and 256 are charged opposite the target electrode 252.

Figure 25:
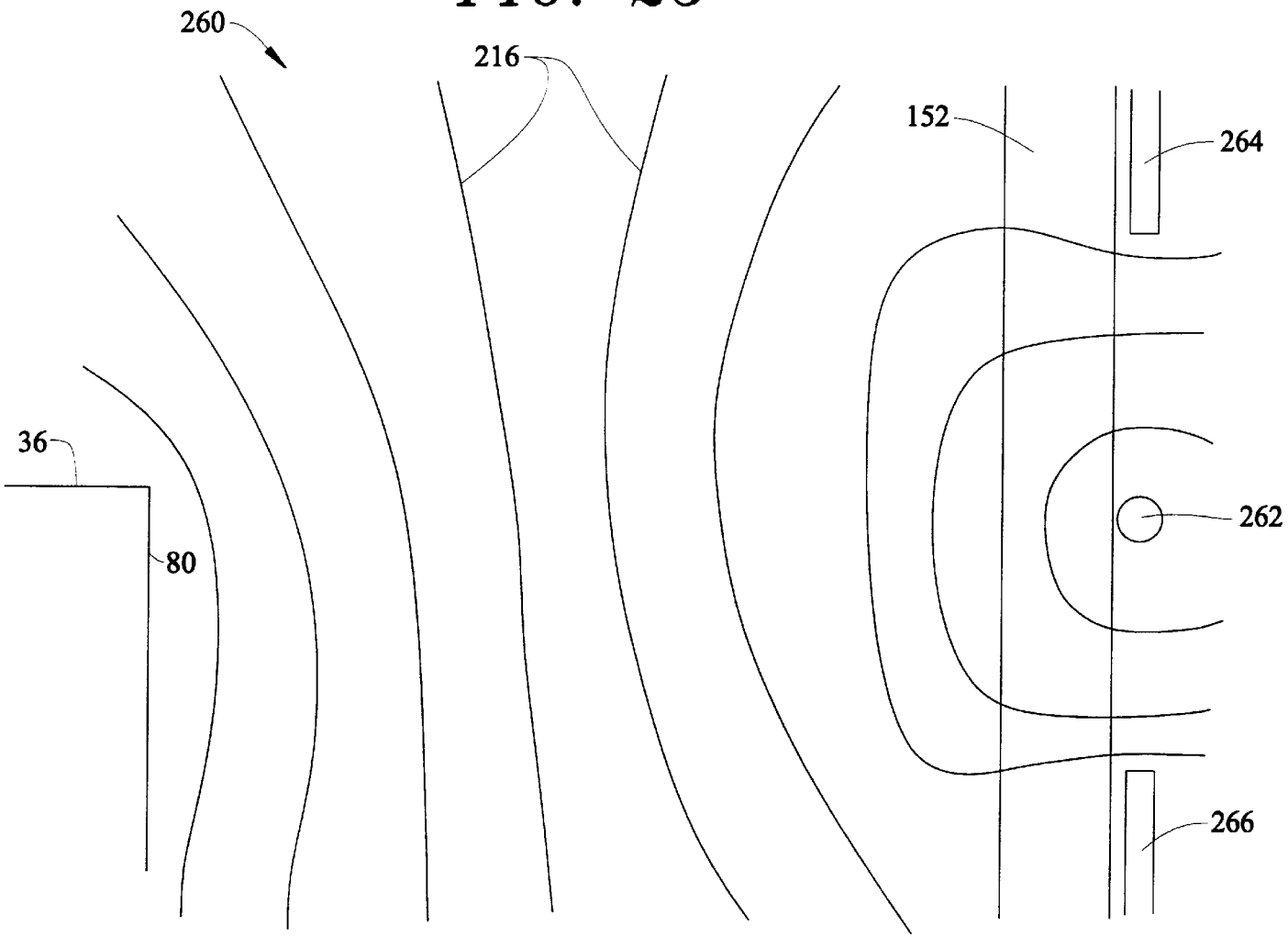
FIG. 25 illustrates an apparatus having focusing electrodes for facilitating transfer of toner from the print head onto a print medium.

The effect of an electrostatic lense in the gap 214 can also be achieved by creating a fringe-field using a lense structure 260 located near the print medium 152, as illustrated in FIG. 25. The lense structure 260 includes a target electrode 262, which may be a field-concentrating electrode, for instance. The target electrode 262 is flanked by additional focusing electrodes 264 and 266 that are charged to repel and focus the toner particles 42 as they approach the target area on the print medium 152. The lense structure 260 may exhibit a tendency to disrupt the final toner image on the print medium 152 due to the translation of the fringe field through the print medium 152, a disruption referred to as electrostatic shearing. To accommodate for this possibility, the adhesion of toner particles 42 to the print medium 152 may be increased, for example, by the application of heat to the print medium 152 and/or to the structure 260. This can reduce the tendency of toner to be displaced once it has reached the print medium 152.

Figure 26:
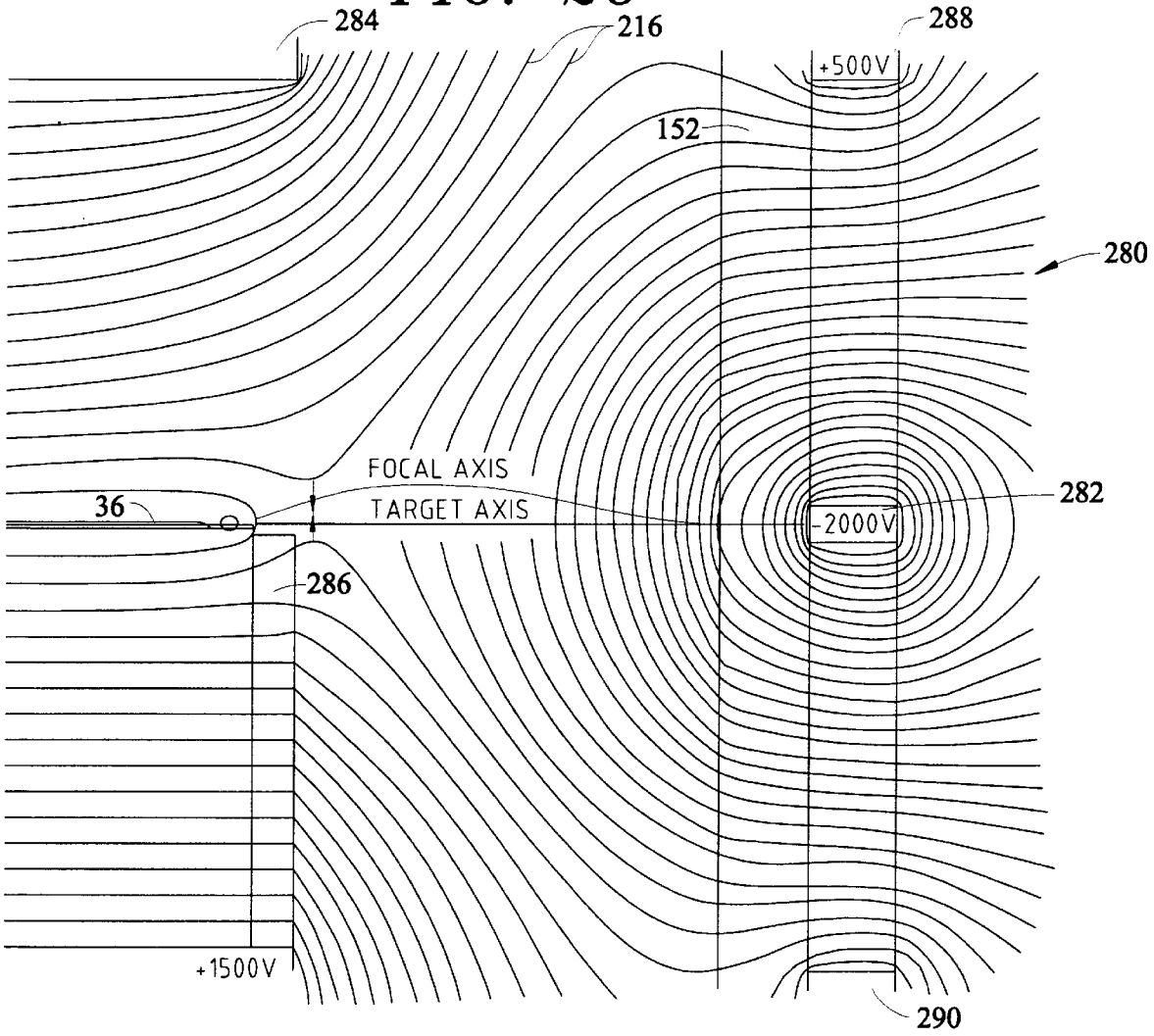
FIG. 26 illustrates an apparatus having focusing and planarizing electrodes for facilitating transfer of toner from the print head onto a print medium.

The combined influences of various of the above-mentioned structural features can be utilized in a toner transfer system which provides driving force, launch field planarization, electrostatic capture and confinement of charged toner particles to a target axis, and focusing toward a well-defined target. One such combined electrostatic lense 280 is illustrated in FIG. 26. The combination of the wire target electrode 282, the planarizing electrodes 284 and 286, and the focusing electrodes 288 and 290 may produce a good field shape both near the end 80 of the print head 36 and near the target area of the print medium 152.

Figure 27:
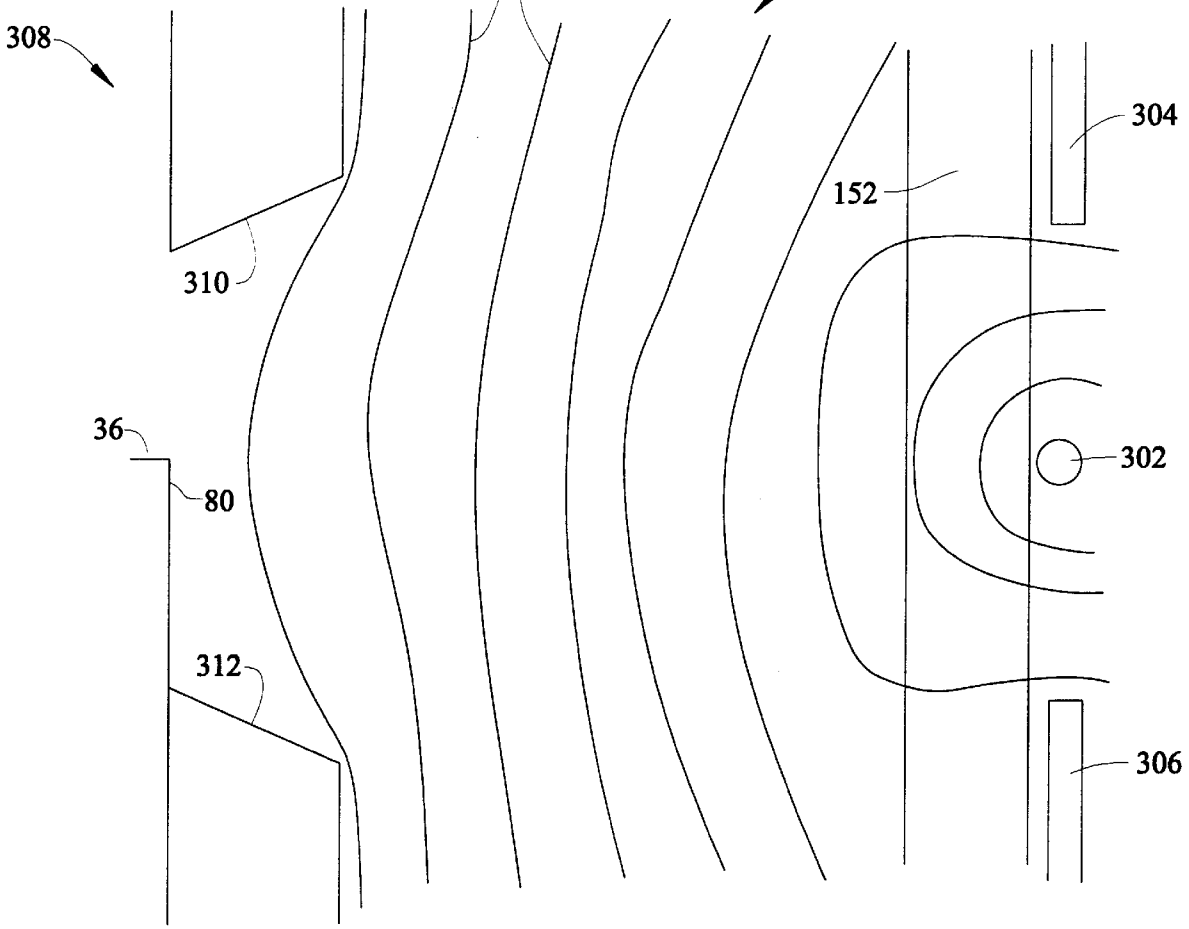
FIG. 27 illustrates another apparatus having focusing and planarizing electrodes for facilitating transfer of toner from the print head onto a print medium.

Although a number of possible configurations may be envisioned, possibly driven by manufacturing considerations, another embodiment of a combined electrostatic lense 300 is illustrated in FIG. 27. The lense 300 includes a wire or planar target electrode 302 flanked by a pair of focusing electrodes 304 and 306. A planarizing structure 308 located near the launch end 80 of the print head 36 includes a dielectric member part coated on two surfaces 310 and 312 with a thin conductive layer. The conductive layer on the surfaces 310 and 312 provides planarizing and focusing elements near the end 80 of the print head 36. Rather than using a dielectric substrate, these elements may be made entirely of metal, and the surfaces 310 and 312 might be angled or curved in such a way as to achieve the desired field shape.

Aside from the requirement that the components fit into the available space, transfer of toner from the end of the traveling-wave transport device across an air gap to the print medium places no specific requirements on the size or number of focusing elements which drive the transfer. Indeed, any arrangement that generates fields in the gap that are of sufficient magnitude and direction to drive the toner particles from the end of the transport device to a well defined location in plane of the print medium may be suitable.

There are also some considerations unique to this design, primarily because of the imposed asymmetry (distortion) of the focusing field arising from the differences in the dielectric properties of the subregions of the space between field-shaping electrodes. The silicon wafer on which the transport array is built has a thickness of about one half millimeter and a dielectric constant of about twelve. The one half millimeter or so of air above the array has a dielectric constant of about one. This imposes an asymmetry in the electric field which has the effect of making the focusing system become asymmetric, as illustrated in FIG. 26.

Figure 28:
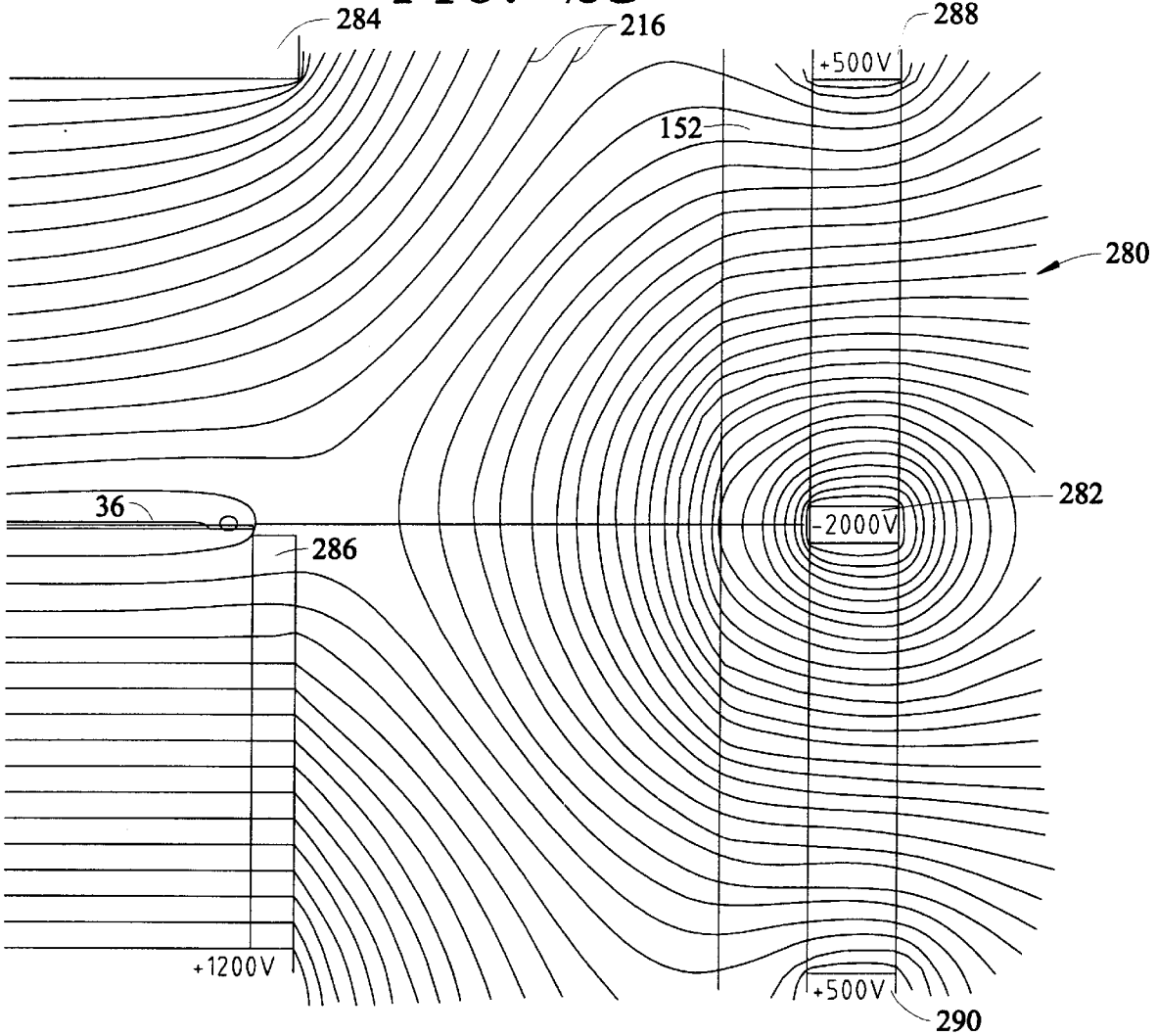
FIG. 28 illustrates the apparatus of FIG. 26 having planarizing electrodes with different voltages.
Figure 29:
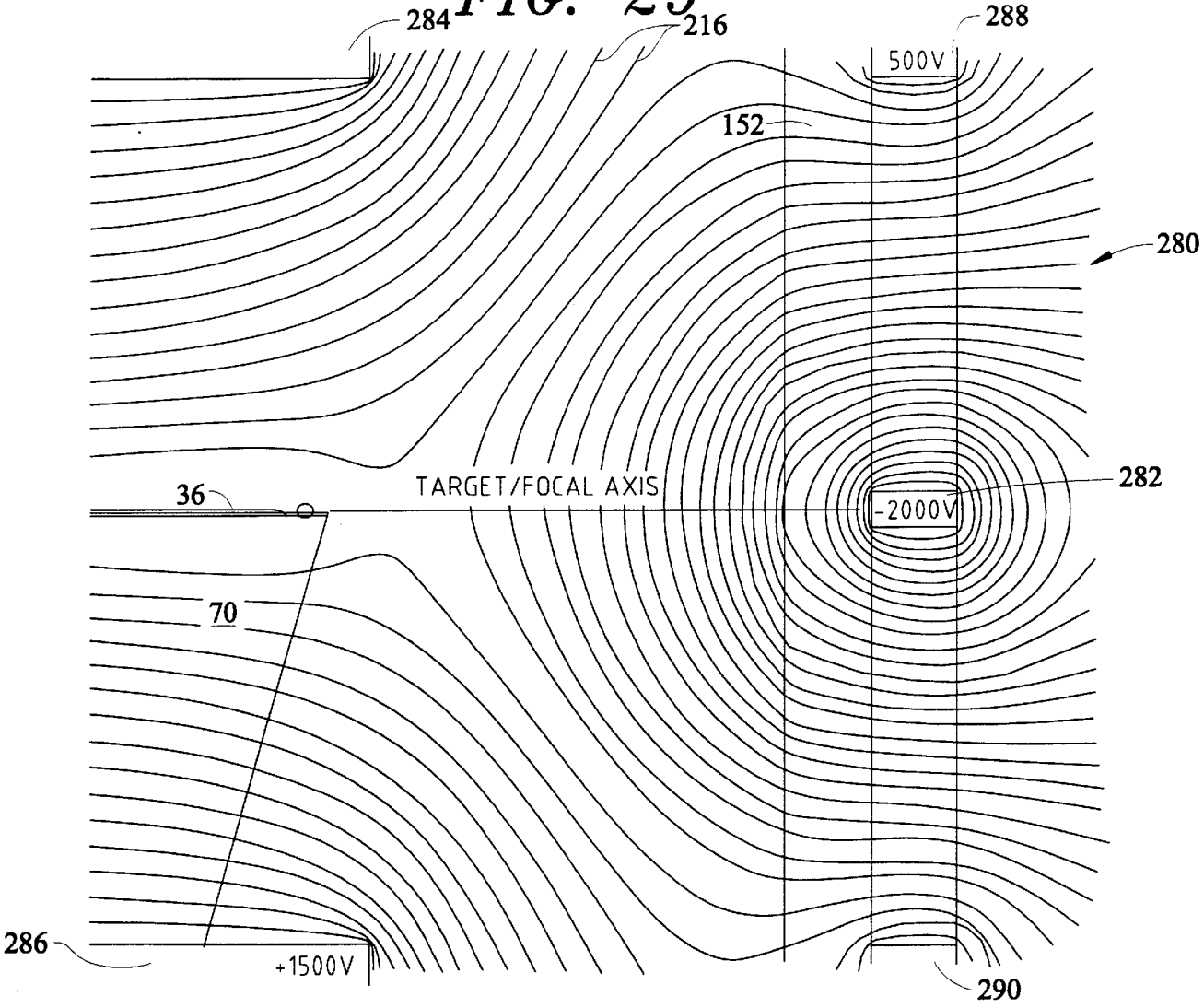
FIG. 29 illustrates an apparatus having focusing and planarizing electrodes for facilitating transfer of toner from the print head onto a print medium, where the print head has an altered substrate.
Figure 30:
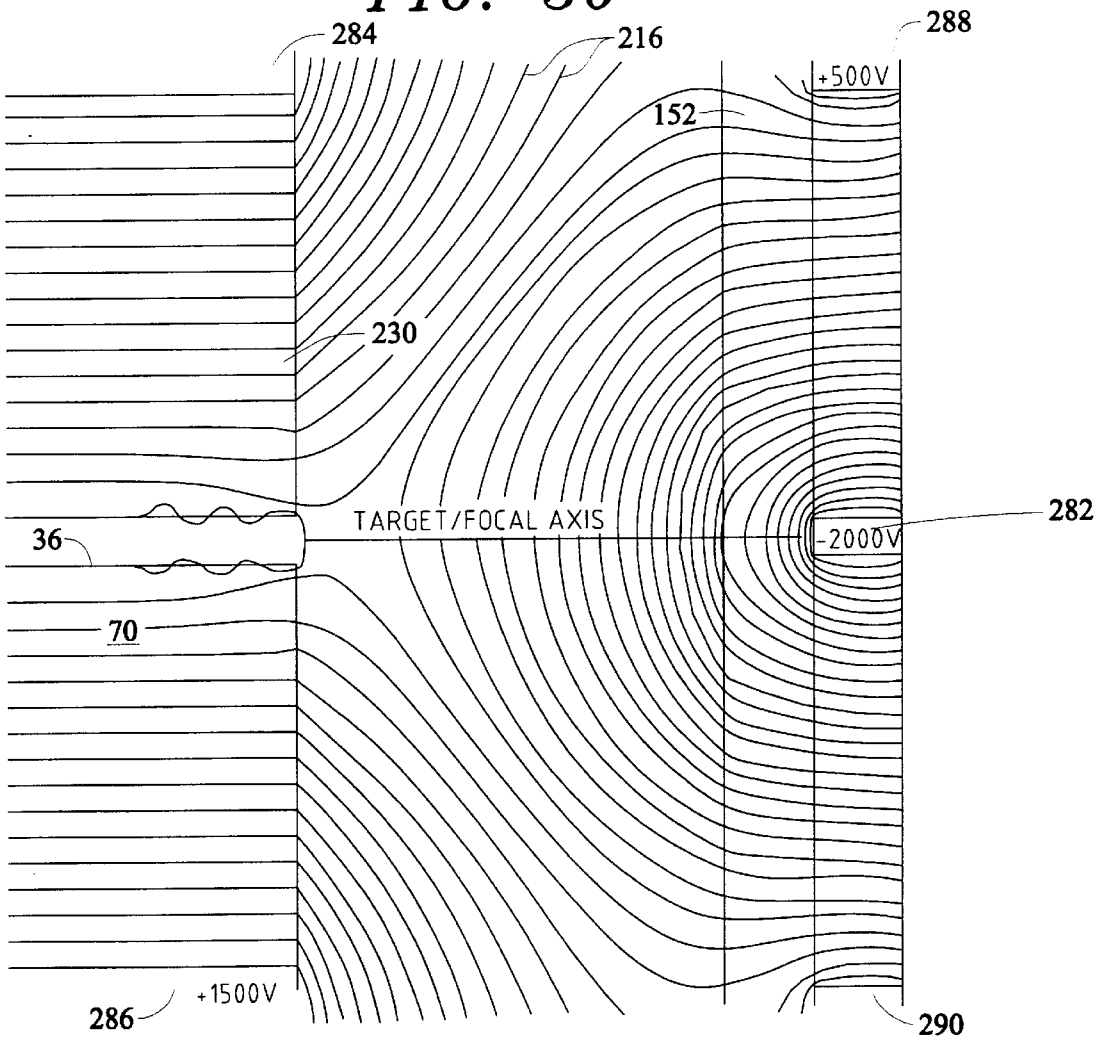
FIG. 30 illustrates an apparatus having focusing and planarizing electrodes for facilitating transfer of toner from the print head onto a print medium, where a dielectric member is positioned over the launch end of the print head.

This potential problem can be managed in various ways. First and simplest, the applied voltages can be made to differ on the top and bottom field-shaping electrodes, like the electrodes 284 and 286, by an amount which compensates for the material's asymmetry, as illustrated in FIG. 28. Second, the silicon substrate can be physically modified to cause this asymmetry to tend to vanish near the end 80 of the array 63, as illustrated in FIG. 29. Third, the region of space below the upper field-shaping electrode, such as the electrode 284, and above the surface of the launch end 80 of the print head 36 can be occupied by a dielectric material 320, as illustrated in FIG. 30. One or more of these approaches may be used to address the concern of asymmetry.

The above discussion has been directed to the transfer of toner packets 48 across a gap 214. However, as the size of the gap 214 decreases toward zero, many of the concerns mentioned above cease to be concerns. Once the gap 214 has been reduced to near zero, e.g., below 50 microns, the transfer field near the end 80 of the print head 36 is smooth enough to reduce concerns about the divergence of the toner paths, and the driving force across the small gap also prevents divergence of toner paths. Such a contact or near-contact transfer scheme may be suitable for monochrome applications. It may also be used in color applications, particularly if intermediate transfer surfaces are employed.

Finally, given the possibility of the toner striking the print medium 152 at a position which is above or below the nominal target location, depending upon the local positioning accuracy of the above-mentioned focusing elements, a calibration technique may be used on a pixel-by-pixel basis to compensate for misalignment of pixels from color plane to color plane as well as within a single plane. One approach to calibration involves the generation of a test image and the evaluation of the image by manual or automated means to provide information to the image-modulating electronics within the printing device for correction of pixel misalignment. Such information could be stored within a PROM inside the printer or in the printer driver software.

9. Vertical Toner Transfer

The methodologies described above have dealt primarily with the transfer of toner particles 42 across a gap to a print medium 152 where the direction of toner motion has been confined to the plane of the toner transport device. However, even with the improvements discussed above, it may still be difficult to produce an adequate image. Therefore, an alternative transfer methodology, termed herein as "vertical toner transfer," is described below. Transferring toner particles 42 vertically from the print head 36 before the end 80, rather than longitudinally from the end 80, results in image information being maintained more accurately, and also allows for relaxed manufacturing tolerances on the location of the end 80 of the print head 36.

Figure 31:
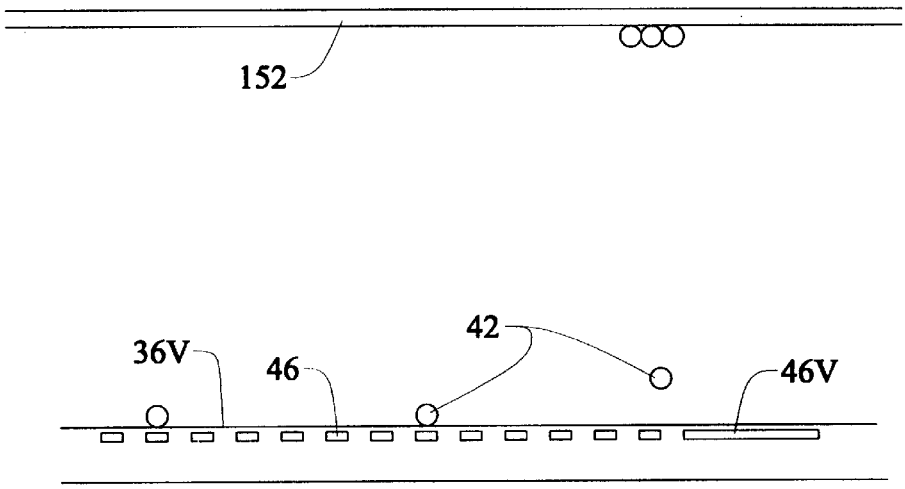
FIG. 31 illustrates a vertical transfer scheme.

As illustrated in FIG. 31, the print head 36V includes a plurality of electrodes 46 that produce the traveling wave for transporting the toner particles 42. A transfer electrode 46V is located at a prescribed location on the print head 36V, typically near the end 80. The transfer electrode 46V is energized to repel toner particles 42 generally vertically away from the surface of the print head 36V to the nearby print medium 152. The physical size of the transfer electrode 46V should be large enough to prevent any toner particles 42 from jumping over it and returning to the surface of the print head 36V. It is currently believed that the transfer electrode 46V should be at least about 1.5 times the diameter of the average toner particle 42 and at least one third of the wavelength of the traveling wave drive.

However, even for a large transfer electrode 46V, fringe fields may be generated between the transfer electrode 46V and the nearby drive electrodes 46. These fringe fields can produce undesirable launch conditions for toner particles 42, depending on where the toner particles 42 are relative to the phase of the traveling wave drive as they leave the surface. Such launch conditions can have the effect of blurring the arrival position of the toner particles 42 on the print medium 152.

Figure 32:
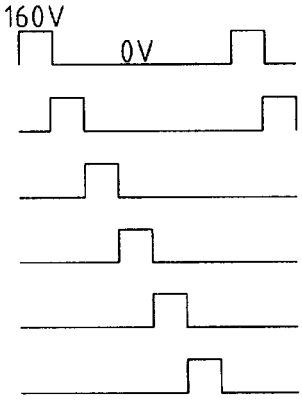
FIG. 32 illustrates voltage waveforms on drive electrodes.

To address this problem, the electric field in the transfer region should be nearly planar from the point of launch to the point of arrival. Of course, small gaps are advantageous, with gaps of 50 to 150 microns being particularly useful. However, it is possible to minimize the scattering problem caused by fringe fields by carefully matching the fields produced by the drive electrodes 46 and the transfer electrode 46V. The goal is to cause the drive field to disappear or to be greatly diminished when the toner particles 42 reach the transfer location. One way to achieve this is to use a pulse drive, instead of a sine wave drive, with a significant asymmetry in the pulse. With a pulse drive, when the last drive electrode 46 turns off, the nearest energized electrode 46 is suddenly nearly a full wavelength back, and the resulting fringe fields at the transfer location are minimized. For example, using a six-phase drive scheme, an effective approach is to use a drive that energizes only one or two of the six electrodes 46 in each wavelength at a time, while the drive holds the remaining electrodes 46 at ground, as illustrated by the voltage waveforms for the electrodes 46 in FIG. 32. This approach sharpens the confinement location for toner particles 42 within the wavelength, e.g., there is less phase lag variation. Therefore, a near planar dc transfer field can be established from the transfer electrode 46V to the print medium 152.

Although this drive scheme accomplishes the objective stated above, it does exhibit certain disadvantages. For example, this scheme may result in a possible reduction in the maximum achievable drive speed for a given device structure. Also, higher local fields are generated in the dielectric for the same drive amplitude, so an increase in the strength of the dielectric may be needed.

In terms of optimizing the transfer field, larger fields make particles traverse the gap faster and, thus, tend to reduce spreading and blurring. However, a large transfer field may also tend to pull toner particles 42 off of the surface of the print head 36V before the particles reach the transfer electrode 46V. Although the transport field and imaging forces tend to hold most of the toner particles 42 to the surface to resist such premature transfer, toner particles 42 that happen to slip phase and momentarily leave the surface of the print head 36V may transfer to the print medium 152. Accordingly, a balance should be maintained between a transfer field that is strong enough to produce reliable transfer with minimal image blurring and a transfer field that is so strong that it causes excessive premature transfer.

Figure 33:
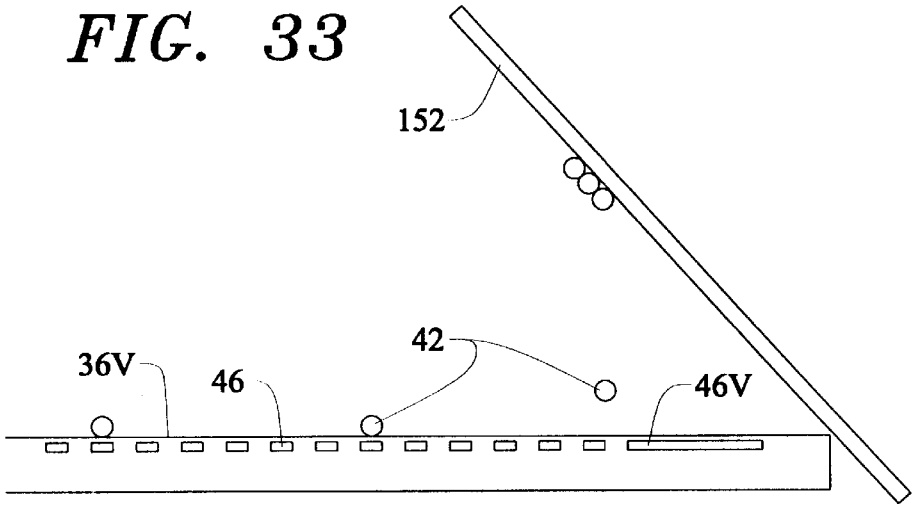
FIG. 33 illustrates an angled transfer scheme.

Because such a balance may be difficult to achieve for typical toner mass and charge distributions, a hybrid geometry may be employed. As illustrated in FIG. 33, toner particles 42 may be vertically transferred from near the end 80 of the print head 36V to the print medium 152 that is angled relative to the surface of the print head 36V. It has been found that, for both vertical transfer and end transfer, the toner particles 42 tend to leave the surface of the print head along a path that angles upwardly. This hybrid geometry takes advantage of this tendency. Because the print medium 152 is angled so that the distance between the print medium 152 and the drive electrodes 46 increases rapidly, the potential for the transfer field to remove toner particles 42 prematurely and deposit them on the print medium 152 is substantially reduced. It is believed that any suitable angle may be implemented, although having the print medium 152 angled between 30 and 60 degrees relative to the surface of the print head 36V appears to be particularly useful.

In one particularly advantageous embodiment, the print medium 152 is angled at about 45 degrees relative to the surface of the print head 36V, with the pivot point of the print medium 152 being about 70 to 100 microns from the location of the transfer electrode 46V. With this configuration, the transfer distance is between about 70 and 100 microns. By applying a de bias voltage of about 70 to 100 volts on the print medium 152 and by grounding the transfer electrode 46V, the toner particles 42 transfer cleanly to the print medium 152 with minimum premature transfer.

10. Conclusion

It should be appreciated that a system fabricated in view of the teachings set forth above may be capable of providing monochromatic or color printing at least on the order of about 10 to 30 pages per minute at a resolution meeting or exceeding 600 DPI. Indeed, due to the speed of toner delivery and the control over such toner, such a system may also be capable of printing a single pixel at any one of at least sixteen different gray levels or color densities. In regard to various color densities, it may be advantageous to use color toner that is somewhat transparent so that consecutive toner packets 48 applied to form a single pixel gradually increase the color density of the pixel.

While the invention may be susceptible to various modifications and alternative forms, specific embodiments have been shown by way of example in the drawings and have been be described in detail herein. However, it should understood that the invention is not intended to be limited to the particular forms disclosed. Rather, the invention is to cover all modifications, equivalents, and alternatives falling within the spirit and scope of the invention as defined by the following appended claims.

What is claimed is:

1. A toner transport device comprising:

a toner transport surface;

a plurality of electrodes disposed adjacent the toner transport surface, the plurality of electrodes being positioned generally parallel to one another and being energizable in groups by a communicating control circuit to generate a traveling wave for transporting toner particles along the toner transport surface, wherein each group of electrodes defines a wavelength of the traveling wave, the wavelength being between about 2.0 to less than 12.0 times an average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels.

2. The toner transport device, as set forth in claim 1, wherein the traveling wave approximates one of a sinusoidal wave and a square wave of any duty cycle.

3. The toner transport device, as set forth in claim 1, wherein the wavelength is between about 2.5 to about 8.8 times the average diameter of the toner particles.

4. The toner transport device, as set forth in claim 1, wherein the wavelength is between about 3.0 to about 4.5 times the average diameter of the toner particles.

5. The toner transport device, as set forth in claim 1, wherein each group of electrodes comprises at least six electrodes.

6. A printer comprising:

a housing;

a toner delivery device disposed within the housing, the toner delivery device comprising:

a toner transport surface;

a plurality of electrodes disposed adjacent the toner transport surface, the plurality of electrodes being positioned generally parallel to one another and being energizable in groups by a communicating control circuit to generate a traveling wave for transporting toner particles along the toner transport surface, wherein each group of electrodes defines a wavelength of the traveling wave, the wavelength being between about 2.5 to about 8.8 times an average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels; and a print medium feed mechanism disposed generally within the housing, the print medium feed mechanism being operable to locate a print medium near the toner delivery device.

7. A toner transport device comprising:

a toner transport surface;

a plurality of electrodes disposed adjacent the toner transport surface, the plurality of electrodes being positioned generally parallel to one another and being energizable in groups of six to eight electrodes by a communicating control circuit to generate a traveling wave for transporting toner particles along the toner transport surface; and a plurality of dividers disposed adjacent the toner transport surface, the plurality of dividers being positioned generally parallel to one another and being positioned generally perpendicular to the plurality of electrodes to define a plurality of toner transport channels, wherein the toner particles have an average diameter and wherein each group of electrodes defines a wavelength of the traveling wave, the wavelength being between about 2.0 to less than 12.0 times the average diameter of the toner particles.

8. The toner transport device, as set forth in claim 7, wherein the wavelength is between about 2.5 to about 8.8 times the average diameter of the toner particles.

9. The toner transport device, as set forth in claim 8, wherein the wavelength is about between 3.0 to about 4.5 times the average diameter of the toner particles.

10. The toner transport device, as set forth in claim 7, wherein the traveling wave approximates one of a sinusoidal wave and a square wave of any duty cycle.

11. A printer comprising:

a housing;

a toner delivery device disposed within the housing, the toner delivery device comprising:

a toner transport surface;

a plurality of electrodes disposed adjacent the toner transport surface, the plurality of electrodes being positioned generally parallel to one another and being energizable in groups of six to eight electrodes by a communicating control circuit to generate a traveling wave for transporting toner particles along the toner transport surface; and a plurality of dividers disposed adjacent the toner transport surface, the plurality of dividers being positioned generally parallel to one another and being positioned generally perpendicular to the plurality of electrodes to define a plurality of toner transport channels, wherein the toner particles have an average diameter and wherein each group of electrodes defines a wavelength of the traveling wave, the wavelength being between about 2.0 to less than 12.0 times the average diameter of the toner particles; and a print medium feed mechanism disposed generally within the housing, the print medium feed mechanism being operable to locate a print medium near the toner delivery device.

12. The toner transport device, as set forth in claim 11, wherein the wavelength is about between 3.0 to about 4.5 times the average diameter of the toner particles.

13. A toner transport device comprising:

a toner transport surface;

a plurality of electrodes disposed adjacent the toner transport surface, the plurality of electrodes being positioned generally parallel to one another to produce an electric field for transporting toner particles along the toner transport surface, the toner particles having an average diameter, and each of the plurality of electrodes having a center and being spaced apart from one another by a given distance between centers of adjacent electrodes, wherein the given distance is less than twice the average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels.

14. The toner transport device, as set forth in claim 13, wherein the electric field approximates one of a sinusoidal wave and a square wave of any duty cycle.

15. The toner transport device, as set forth in claim 13, wherein the wavelength is between about 2.2 and 8.8 times the average diameter of the toner particles.

16. The toner transport device, as set forth in claim 13, wherein the wavelength is between about 3.0 to about 4.5 times the average diameter of the toner particles.

17. A printer comprising:

a housing;

a toner delivery device disposed within the housing, the toner delivery device comprising:

a toner transport surface;

a plurality of electrodes disposed adjacent the toner transport surface, the plurality of electrodes being positioned generally parallel to one another to produce an electric field for transporting toner particles along the toner transport surface, the toner particles having an average diameter, and each of the plurality of electrodes having a center and being spaced apart from one another by a given distance between centers of adjacent electrodes, wherein the given distance is less than twice the average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels; and a print medium feed mechanism disposed generally within the housing, the print medium feed mechanism being operable to locate a print medium near the toner delivery device.

18. The printer, as set forth in claim 17, further comprising:

a control circuit coupled to the plurality of electrodes, the control circuit delivering voltage signals to the plurality of electrodes to generate the electric field.

19. A toner transport device comprising:

a toner transport surface;

a plurality of electrodes disposed adjacent the toner transport surface, the plurality of electrodes being positioned generally parallel to one another to produce an electric field for transporting toner particles along the toner transport surface, each of the plurality of electrodes having a center and being spaced apart from one another by a given distance between centers of adjacent electrodes, wherein the given distance is not greater than an average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels.

20. The toner transport device, as set forth in claim 19, wherein the electric field comprises a traveling wave.

21. The toner transport device, as set forth in claim 20, wherein the traveling wave approximates one of a sinusoidal wave and a square wave of any duty cycle.

22. The toner transport device, as set forth in claim 19, wherein the given distance is less than one-half the average diameter of the toner particles.

23. A printer comprising:

a housing;

a toner delivery device disposed within the housing, the toner delivery device comprising:

a toner transport surface;

a plurality of electrodes disposed adjacent the toner transport surface, the plurality of electrodes being positioned generally parallel to one another to produce an electric field for transporting toner particles along the toner transport surface, each of the plurality of electrodes having a center and being spaced apart from one another by a given distance between centers of adjacent electrodes, wherein the given distance is not greater than an average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels; and a print medium feed mechanism disposed generally within the housing, the print medium feed mechanism being operable to locate a print medium near the toner delivery device.

24. The printer, as set forth in claim 23, further comprising:

a control circuit coupled to the plurality of electrodes, the control circuit delivering voltage signals to the plurality of electrodes to generate the electric field.

25. The printer, as set forth in claim 24, wherein the electric field comprises a traveling wave.

26. A toner transport device comprising:

a toner transport surface;

a plurality of electrodes disposed adjacent the toner transport surface, the plurality of electrodes being positioned generally parallel to one another and being energizable in groups of at least six electrodes by a communicating control circuit to generate a traveling wave for transporting toner particles along the toner transport surface, each of the plurality of electrodes having a center and being spaced apart from one another by a given distance between centers of adjacent electrodes, wherein each group of electrodes defines a wavelength of the traveling wave, the wavelength being between about 3.0 to about 4.5 times an average diameter of the toner particles, and wherein the given distance is not greater than the average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels.

27. The toner transport device, as set forth in claim 26, wherein the traveling wave approximates one of a sinusoidal wave and a square wave of any duty cycle.

28. A printer comprising:

a housing;

a toner delivery device disposed within the housing, the toner delivery device comprising:

a toner transport surface;

a plurality of electrodes disposed adjacent the toner transport surface, the plurality of electrodes being positioned generally parallel to one another and being energizable in groups of at least six electrodes to generate a traveling wave for transporting toner particles along the toner transport surface, each of the plurality of electrodes having a center and being spaced apart from one another by a given distance between centers of adjacent electrodes, wherein each group of electrodes defines a wavelength of the traveling wave, the wavelength being between about 3.0 to about 4.5 times an average diameter of the toner particles, and wherein the given distance is not greater than the average diameter of the toner particles; and a plurality of dividers disposed adjacent the toner transport surface, the plurality of dividers being positioned generally parallel to one another and being positioned generally perpendicular to the plurality of electrodes to define a plurality of toner transport channels; and a print medium feed mechanism disposed generally within the housing, the print medium feed mechanism being operable to locate a print medium near the toner delivery device.

29. A toner transport device comprising:

a substrate;

a first dielectric material being disposed over the substrate;

a plurality of electrodes disposed over the first dielectric material, the plurality of electrodes being positioned parallel to one another to produce a traveling wave; and at least a second dielectric material being disposed in a non-conformal layer over the plurality of electrodes to create a substantially smooth toner transport surface.

30. The toner transport device, as set forth in claim 29, wherein the substrate comprises one of silicon, glass, and ceramic.

31. The toner transport device, as set forth in claim 29, wherein the first dielectric material comprises one of a silicon oxide and a silicon nitride.

32. The toner transport device, as set forth in claim 29, wherein the second dielectric material comprises benzocyclobutene.

33. The toner transport device, as set forth in claim 29, therein the second dielectric material extends between about 0.3 to 3.0 microns over the plurality of electrodes.

34. The toner transport device, as set forth in claim 29, further comprising:

a plurality of dividers disposed adjacent the toner transport surface, the plurality of dividers being positioned generally perpendicular to the plurality of electrodes to define a plurality of toner transport channels.

35. A printer comprising:

a housing;

a toner delivery device disposed within the housing, the toner delivery device comprising:

a substrate;

a first dielectric material being disposed over the substrate;

a plurality of electrodes disposed over the first dielectric material, the plurality of electrodes being positioned parallel to one another to produce a traveling wave; and a second dielectric material being disposed in a non-conformal layer over the plurality of electrodes to create a toner transport surface; and a print medium feed mechanism disposed generally within the housing, the print medium feed mechanism being operable to locate a print medium near the toner delivery device.

36. The printer, as set forth in claim 35, further comprising:

a control circuit coupled to the plurality of electrodes, the control circuit delivering voltage signals to the plurality of electrodes to generate the traveling wave.

37. The printer, as set forth in claim 35, wherein the substrate comprises one of silicon, glass, and ceramic.

38. The printer, as set forth in claim 35, wherein the first dielectric material comprises one of a silicon oxide and a silicon nitride.

39. The printer, as set forth in claim 35, wherein the second dielectric material comprises benzocyclobutene.

40. The printer, as set forth in claim 35, wherein the second dielectric material extends between about 0.3 and 3.0 microns over the plurality of electrodes.

41. The printer, as set forth in claim 35, further comprising:

a plurality of dividers disposed adjacent the toner transport surface, the plurality of dividers being positioned generally perpendicular to the plurality of electrodes to define a plurality of toner transport channels.

42. A toner transport device comprising:

a substrate;

a first dielectric material disposed over the substrate;

a first plurality of electrodes disposed over the first dielectric material;

a second dielectric material disposed over the first plurality of electrodes;

a second plurality of electrodes disposed over the second dielectric material, the second plurality of electrodes being positioned generally perpendicular to the first plurality of electrodes; and a third dielectric material disposed in a non-conformal layer over the second plurality of electrodes to create a toner transport surface.

43. The toner transport device, as set forth in claim 42, wherein the substrate comprises one of silicon, glass, and ceramic.

44. The toner transport device, as set forth in claim 42, wherein the first dielectric material comprises one of a silicon oxide and a silicon nitride.

45. The toner transport device, as set forth in claim 42, wherein the second dielectric material comprises benzocyclobutene.

46. The toner transport device, as set forth in claim 42, wherein the third dielectric material comprises benzocyclobutene.

47. The toner transport device, as set forth in claim 42, wherein the second and third dielectric material have a combined thickness that extends between about 0.3 to about 3.0 microns over the first plurality of electrodes.

48. The toner transport device, as set forth in claim 42, wherein the first plurality of electrodes are arranged to produce a traveling wave.

49. The toner transport device, as set forth in claim 42, wherein the second plurality of electrodes define a plurality of toner transport channels.

50. A printer comprising:

a housing;

a toner delivery device disposed within the housing, the toner delivery device comprising:

a substrate;

a first dielectric material disposed over the substrate;

a first plurality of electrodes disposed over the first dielectric material;

a second dielectric material disposed over the first plurality of electrodes;

a second plurality of electrodes disposed over the second dielectric material, the second plurality of electrodes being positioned generally perpendicular to the first plurality of electrodes; and a third dielectric material disposed in a non-conformal layer over the second plurality of electrodes to create a toner transport surface; and a print medium feed mechanism disposed generally within the housing, the print medium feed mechanism being operable to locate a print medium near the toner delivery device.

51. The printer, as set forth in claim 50, further comprising:

a control circuit coupled to the first plurality of electrodes, the control circuit delivering voltage signals to the first plurality of electrodes to generate a traveling wave.

52. The printer, as set forth in claim 50, wherein the substrate comprises one of silicon, glass, and ceramic.

53. The printer, as set forth in claim 50, wherein the first dielectric material comprises one of a silicon oxide and a silicon nitride.

54. The printer, as set forth in claim 50, wherein the second dielectric material comprises benzocyclobutene.

55. The printer, as set forth in claim 50, wherein the third dielectric material comprises benzocyclobutene.

56. The printer, as set forth in claim 50, wherein the second and third dielectric material have a combined thickness that extends between about 0.3 to about 3.0 microns over the first plurality of electrodes.

57. The printer, as set forth in claim 50, wherein the first plurality of electrodes are arranged to produce a traveling wave.

58. The printer, as set forth in claim 50, wherein the second plurality of electrodes define a plurality of toner transport channels.

59. A toner transport device comprising:

a substrate;

a first dielectric material disposed over the substrate;

a plurality of electrodes disposed over the first dielectric material, the plurality of electrodes being positioned to produce an electric field for transporting toner particles;

a second dielectric material disposed in a non-conformal layer over the first plurality of electrodes to form a toner transport surface; and a plurality of dielectric rails disposed over the toner transport surface, the plurality of dielectric rails being positioned generally perpendicular to the plurality of electrodes to form a plurality of toner transport channels.

60. The toner transport device, as set forth in claim 59, wherein the substrate comprises one of silicon, glass, and ceramic.

61. The toner transport device, as set forth in claim 59, wherein the first dielectric material comprises one of a silicon oxide and a silicon nitride.

62. The toner transport device, as set forth in claim 59, wherein the second dielectric material comprises benzocyclobutene.

63. The toner transport device, as set forth in claim 59, wherein the second dielectric material extends between about 0.3 and about 3.0 microns over the plurality of electrodes.

64. A printer comprising:

a housing;

a toner delivery device disposed within the housing, the toner delivery device comprising:

a substrate;

a first dielectric material disposed over the substrate;

a plurality of electrodes disposed over the first dielectric material, the plurality of electrodes being positioned to produce an electric field for transporting toner particles;

a second dielectric material disposed in a non-conformal layer over the first plurality of electrodes to form a toner transport surface; and a plurality of dielectric rails disposed over the second dielectric material, the plurality of dielectric rails being positioned generally perpendicular to the plurality of electrodes to form a plurality of toner transport channels; and a print medium feed mechanism disposed generally within the housing, the print medium feed mechanism being operable to locate a print medium near the toner delivery device.

65. The printer, as set forth in claim 64, further comprising:

a control circuit coupled to the plurality of electrodes, the control circuit delivering voltage signals to the plurality of electrodes to generate the traveling wave.

66. The printer, as set forth in claim 64, wherein the substrate comprises one of silicon, glass, and ceramic.

67. The printer, as set forth in claim 64, wherein the first dielectric material comprises one of a silicon oxide and a silicon nitride.

68. The printer, as set forth in claim 64, wherein the second dielectric material comprises benzocyclobutene.

69. The printer, as set forth in claim 64, wherein the second dielectric material extends between about 0.3 and 3.0 microns over the plurality of electrodes.

70. A method of fabricating a toner transport device, the method comprising the steps of:

(a) disposing a first dielectric material over a substrate;

(b) forming a plurality of electrodes over the first dielectric material, the plurality of electrodes being positioned to produce a traveling wave; and (c) forming a non-conformal layer of a second dielectric material over the plurality of electrodes to create a toner transport surface.

71. The method, as set forth in claim 70, wherein step (c) comprises the step of:

depositing a non-conformal layer of benzocyclobutene over the plurality of electrodes.

72. The method, as set forth in claim 70, wherein step (c) comprises the steps of:

depositing a conformal layer of the second dielectric material over the plurality of electrodes, and planarizing the conformal layer of the second dielectric material to form the non-conformal layer of the second dielectric material.

73. The method, as set forth in claim 72, wherein the step of planarizing comprises the step of:

planarizing the conformal layer of the second dielectric material using chemical-mechanical planarization.

74. The method, as set forth in claim 72, wherein the step of planarizing comprises the step of:

planarizing the conformal layer of the second dielectric material using a chemical etch.

75. A method of fabricating a toner transport device, the method comprising the steps of:

(a) disposing a first dielectric material over a substrate;

(b) forming a first plurality of electrodes over the first dielectric material;

(c) forming a second dielectric material over the first plurality of electrodes;

(d) forming a second plurality of electrodes over the second dielectric material;

(e) forming a non-conformal layer of a third dielectric material over the second plurality of electrodes to create a toner transport surface.

76. The method, as set forth in claim 75, wherein step (b) comprises the step of:

positioning the first plurality of electrodes parallel to one another.

77. The method, as set forth in claim 75, wherein step (d) comprises the step of:

positioning the second plurality of electrodes parallel to one another and perpendicular to the first plurality of electrodes.

78. The method, as set forth in claim 75, wherein step (e) comprises the step of:

depositing a non-conformal layer of benzocyclobutene over the second plurality of electrodes.

79. The method, as set forth in claim 75, wherein step (e) comprises the steps of:

depositing a conformal layer of the third dielectric material over the second plurality of electrodes; and planarizing the conformal layer of the third dielectric material to form the non-conformal layer of the third dielectric material.

80. The method, as set forth in claim 79, wherein the step of planarizing comprises the step of, planarizing the conformal layer of the third dielectric material using chemical-mechanical planarization.

81. The method, as set forth in claim 79, wherein the step of planarizing comprises the step of:

planarizing the conformal layer of the third dielectric material using a chemical etch.

82. A method of fabricating a toner transport device, the method comprising the steps of:

(a) disposing a first dielectric material over a substrate;

(b) forming a plurality of electrodes over the first dielectric material, the plurality of electrodes being positioned to produce a traveling wave;

(c) forming a non-conformal layer of a second dielectric material over the plurality of electrodes to create a toner transport surface; and (d) forming a plurality of dielectric rails over the toner transport surface, the plurality of dielectric rails being positioned generally perpendicular to the plurality of electrodes to form a plurality of toner transport channels.

83. The method, as set forth in claim 82, wherein step (c) comprises the step of:

depositing a non-conformal layer of benzocyclobutene over the plurality of electrodes.

84. The method, as set forth in claim 82, wherein step (c) comprises the steps of:

depositing a conformal layer of the second dielectric material over the plurality of electrodes; and planarizing the conformal layer of the second dielectric material to form the non-conformal layer of the second dielectric material.

85. The method, as set forth in claim 84, wherein the step of planarizing comprises the step of:

planarizing the conformal layer of the second dielectric material using chemical-mechanical planarization.

86. The method, as set forth in claim 84, wherein the step of planarizing comprises the step of:

planarizing the conformal layer of the second dielectric material using a chemical etch.

* * * * *